US011458505B2

(12) United States Patent
Lipa

(10) Patent No.: US 11,458,505 B2
(45) Date of Patent: Oct. 4, 2022

(54) DEBLINDING APPARATUSES AND METHODS FOR SCREENING

(71) Applicant: Derrick Corporation, Buffalo, NY (US)

(72) Inventor: Anthony J. Lipa, Williamsville, NY (US)

(73) Assignee: DERRICK CORPORATION, Buffalo, NY (US)

( * ) Notice: Subject to any disclaimer, the term of this patent is extended or adjusted under 35 U.S.C. 154(b) by 972 days.

(21) Appl. No.: 16/117,798

(22) Filed: Aug. 30, 2018

(65) Prior Publication Data

US 2019/0070638 A1 Mar. 7, 2019

Related U.S. Application Data

(60) Provisional application No. 62/553,668, filed on Sep. 1, 2017.

(51) Int. Cl.
*B07B 1/46* (2006.01)
*B07B 1/54* (2006.01)
*B07B 1/40* (2006.01)

(52) U.S. Cl.
CPC ..... *B07B 1/4618* (2013.01); *B07B 1/40* (2013.01); *B07B 1/54* (2013.01)

(58) Field of Classification Search
CPC ..... B07B 1/4618; B07B 1/40; B07B 1/50; B07B 1/54
See application file for complete search history.

(56) References Cited

U.S. PATENT DOCUMENTS 1,562,311 A 11/1925 Dimm
2,455,383 A * 12/1948 Pickard ..... B07B 1/526 209/323

(Continued)

FOREIGN PATENT DOCUMENTS

CN 104070012 A 10/2014
CN 204276351 U 4/2015

(Continued)

*Primary Examiner* — Michael McCullough
*Assistant Examiner* — Kalyanavenkateshware Kumar
(74) *Attorney, Agent, or Firm* — FisherBroyles, LLP; Jason P. Mueller

(57) ABSTRACT

Deblinding apparatuses and deblinding methods are provided. A deblinding apparatus may include a support frame including a grid structure and multiple compartments. Multiple compartments may be formed by a respective portion of the grid structure and a respective set of support members. Further, multiple scattering members may be disposed within a compartment. Scattering members be removably affixed to a portion of the grid structure that forms a part of a compartment. Multiple unsecured objects may be placed within a compartment. When attached to a screen and in response to movement of support frame, at least one unsecured object of the multiple unsecured objects may collide with a first scattering member and with a surface of the screen to thereby cause deblinding of the screen. Sizes, shapes, masses, and morphologies of unsecured objects may be designed to optimize collision rates of unsecured objects with scattering members and with the screen assembly.

24 Claims, 22 Drawing Sheets

(56) References Cited

U.S. PATENT DOCUMENTS

| | | | | | |
|---|---|---|---|---|---|
| 2,858,023 | A * | 10/1958 | Holland | B07B 1/54 | 209/381 |
| 3,664,503 | A | 5/1972 | Felden | | |
| 3,960,731 | A * | 6/1976 | Brandt | B07B 1/54 | 210/332 |
| 4,028,230 | A | 6/1977 | Rosenblum | | |
| 4,100,248 | A | 7/1978 | Adams | | |
| 4,122,006 | A * | 10/1978 | Christensen | B07B 1/54 | 209/382 |
| 4,222,865 | A | 9/1980 | Valeri et al. | | |
| 4,234,413 | A * | 11/1980 | Summers | B01D 21/0012 | 209/17 |
| 4,383,919 | A | 5/1983 | Schmidt | | |
| 4,802,591 | A * | 2/1989 | Lower | B07B 1/12 | 209/323 |
| 4,819,809 | A | 4/1989 | Derrick | | |
| 4,836,385 | A | 6/1989 | Slesarenko et al. | | |
| 4,857,176 | A | 8/1989 | Derrick et al. | | |
| 5,051,171 | A * | 9/1991 | Hukki | B07B 1/54 | 209/323 |
| 5,385,669 | A | 1/1995 | Leone, Sr. | | |
| 5,538,139 | A | 7/1996 | Keller | | |
| 5,876,552 | A | 3/1999 | Bakula | | |
| 6,095,339 | A * | 8/2000 | Filip | B07B 1/54 | 209/379 |
| 6,202,857 | B1 * | 3/2001 | Keller | B29C 44/12 | 209/404 |
| 7,000,777 | B2 | 2/2006 | Adams et al. | | |
| 7,484,625 | B2 | 2/2009 | Scott et al. | | |
| 7,861,866 | B1 * | 1/2011 | Ondrias | B07B 1/54 | 209/382 |
| 8,584,866 | B2 | 11/2013 | Lipa et al. | | |
| 8,813,970 | B2 | 8/2014 | Jones | | |
| 9,010,539 | B2 | 4/2015 | Lipa et al. | | |
| 2004/0211707 | A1 | 10/2004 | Lipa | | |
| 2005/0183991 | A1 | 8/2005 | Kriel | | |
| 2011/0253602 | A1 | 10/2011 | Lipa et al. | | |
| 2013/0277282 | A1 | 10/2013 | Lipa et al. | | |
| 2017/0066884 | A1 | 3/2017 | Koichi et al. | | |

FOREIGN PATENT DOCUMENTS

| | | | |
|---|---|---|---|
| FR | 427986 | | 8/1911 |
| FR | 483069 | | 5/1917 |
| GB | 2185698 | A | 7/1987 |
| JP | 6137224 | B2 | 5/2017 |
| KR | 20-0312568 | Y1 | 5/2003 |
| RU | 2246360 | | 2/2005 |
| RU | 2296630 | A | 2/2006 |
| SU | 1599133 | A1 | 10/1990 |
| TW | M258183 | U | 3/2005 |
| TW | M328904 | U | 3/2008 |
| TW | M340860 | U | 9/2008 |
| TW | 200925535 | A | 6/2009 |
| TW | M447274 | U | 2/2013 |
| TW | M459903 | U | 8/2013 |
| TW | M468568 | U | 12/2013 |
| TW | M470701 | U | 1/2014 |
| TW | M479801 | | 6/2014 |
| TW | M481766 | U | 7/2014 |
| TW | M499959 | | 5/2015 |
| TW | M513735 | U | 12/2015 |
| TW | M527789 | U | 9/2016 |
| TW | M529549 | U | 10/2016 |
| TW | M532900 | U | 12/2016 |
| TW | M544259 | U | 7/2017 |
| TW | M556176 | U | 3/2018 |
| WO | 2001/097947 | | 12/2001 |
| WO | 2004020113 | | 3/2004 |

* cited by examiner

DEBLINDING APPARATUSES AND METHODS FOR SCREENING

CROSS REFERENCE TO RELATED APPLICATION

This application claims the benefit of U.S. Provisional Patent Application No. 62/553,668, filed on Sep. 1, 2017, which is incorporated herein by reference in its entirety.

BRIEF DESCRIPTION OF THE DRAWINGS

The accompanying drawings are part of the present disclosure and are incorporated into the specification. The drawings illustrate examples of embodiments of the disclosure and, in conjunction with the description and claims, serve to explain, at least in part, various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein. Like numbers refer to like, but not necessarily the same or identical, elements throughout.

DETAILED DESCRIPTION

Figure 1:
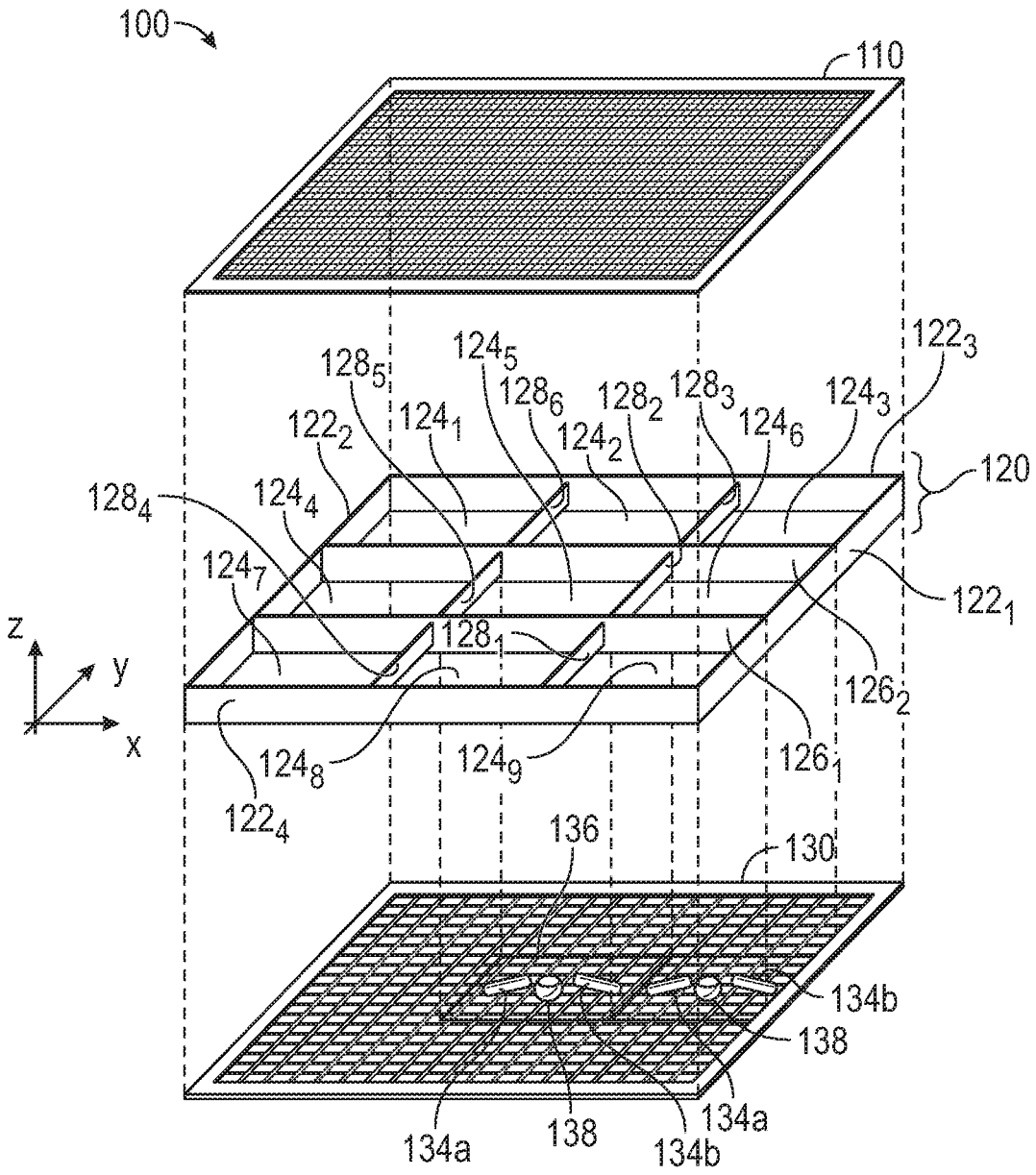
FIG. 1 presents an exploded view of a screening system having a deblinding apparatus, in accordance with one or more embodiments of the disclosure.

Embodiments of the present disclosure provide for deblinding of screens, screen assemblies, and/or other types of material separation apparatuses. Deblinding may refer to the removal of one or more occlusions present in one or more openings of a screen, screen assembly, or material separation apparatus. Particulate matter may lodge in a sifting screen, for example, blocking one or more openings of the sifting screen. The blockage of one or more openings may be referred to as blinding, and the removal of blocking particulate matter may be referred to as deblinding. According disclosed embodiments, deblinding of a sifting screen may rely on collisions of objects with the sifting screen.

A deblinding apparatus may include a support frame, having a rectangular array of support members, and a grid structure (e.g., a metal or plastic grid structure) attached to a first side of the support frame. A plurality of rectangular compartments may be formed when the grid structure is attached to the support frame. In this regard, support members of the support frame forms side-walls of the plurality of rectangular compartments, while portions of the grid structure form bottom surfaces of the rectangular compartments. The deblinding apparatus may further include scattering members disposed within a plurality of the compartments. Such scattering members may be removably affixed to portions of the grid structure that forms bottom surfaces of the rectangular compartments. The scattering members may include rigid objects having elongated shapes (e.g., a strip or a bar) or more symmetric shapes (e.g., a disc or a dome). The deblinding apparatus may further include or more unsecured objects that may be disposed within various compartments.

A screen assembly may be attached to a second side of the support frame to thereby form a screening system having a deblinding apparatus. Attaching the screen assembly to the second side of the support frame causes the rectangular compartments to form three-dimensional closed volumes with portions of the screen assembly forming top surfaces of the closed rectangular compartments. In response to movement of the screening system having the deblinding apparatus, the unsecured objects may collide with scattering members which cause the unsecured scattering members to collide with the screen assembly. Collisions of the unsecured objects with the screen assembly may cause deblinding of the screen assembly, according to embodiments of the present disclosure. Sizes, shapes, masses, and morphologies of unsecured objects may be designed to optimize collision rates of unsecured objects with scattering members and with the screen assembly, as described in greater detail below.

The screening system having a deblinding apparatus may be used to separate solid particulate materials from a slurry (i.e., a material having solid particulates dispersed/suspended in a liquid medium), as follows. During operation of the screening system, the slurry may be introduced onto an external side of the screen assembly. Sizes of screen openings may be chosen to separate and remove particles that are larger than screen openings, while allowing smaller particles to pass through the screen along with the liquid medium. A vibratory/oscillatory motion may be imparted to the screening system to cause the liquid material of the slurry and smaller particles to flow through the screen assembly while leaving larger solid particulate materials on the external surface of the screen assembly, thereby separating the larger dispersed solids from the smaller particles and the liquid medium. After flowing through the screen assembly, the liquid medium and smaller particles may further flow out of the screening system through the grid structure.

While screening slurry materials in this way, various occlusions of screen openings may form as larger solid particles become lodged in screen openings. In other words, the screen assembly may become blinded. The presence of the deblinding apparatus, however, tends to deblind the screen during operation of the screening system. In this regard, the vibratory/oscillatory motion imparted to the screening system, to separate the larger particles from the liquid and smaller particles, also causes the unsecured objects to collide with scattering members, and in turn, to collide with the screen assembly. The collisions with the screen assembly tend to remove occluded particles to thereby deblind the screen assembly. Thus, any occlusions that form during operation are quickly removed by the deblinding system to leave the screen assembly effectively deblinded on average.

Disclosed embodiments are not limited to particular placements of scattering members and unsecured objects within the compartments of the deblinding apparatus. Various configurations of scattering members and unsecured objects may be assembled among the compartments of the deblinding apparatus to adjust collision rates of unsecured objects with the screen assembly.

Disclosed deblinding apparatuses may be used for deblinding of screens/screen assemblies such as those described in U.S. Pat. Nos. 8,584,866; 9,010,539; 9,375,756; 9,403,192 and 9,908,150; each of which is incorporated herein by reference. The disclosed deblinding apparatuses are not limited to use only with screens and screen assemblies of the above-referenced patent documents. Rather, disclosed deblinding apparatuses may be used with other, more conventional, screens and screening systems. In this regard, deblinding apparatuses may be retrofitted for use with existing separation equipment, in accordance with embodiments of the disclosure.

FIG. 1 presents an exploded view of a screening system 100 having a deblinding apparatus, in accordance with one or more embodiments. Screening system 100 includes a screen assembly 110, a support frame 120, and a grid structure 130. Support frame 120 and grid structure 130 form components of a deblinding apparatus, as mentioned above and described in greater detail below. In some embodiments, screen assembly 110 may include a screen having a flexible molded polyurethane body including a first surface, a second surface opposite to the first surface, and an integrally molded array of screening openings.

Support frame 120, of FIG. 1, includes a first plurality of support members (e.g., slabs $\mathbf{128}_1$, $\mathbf{128}_2$, $\mathbf{128}_3$, $\mathbf{128}_4$, $\mathbf{128}_5$, and $\mathbf{128}_6$) and a second plurality of support members (e.g., bars $\mathbf{126}_1$ and $\mathbf{126}_2$) that define a rectangular array of openings. A plurality of rectangular compartments (e.g., compartments $\mathbf{124}_1$, $\mathbf{124}_2$, $\mathbf{124}_3$, $\mathbf{124}_4$, $\mathbf{124}_5$, $\mathbf{124}_6$, $\mathbf{124}_7$, $\mathbf{124}_8$, and $\mathbf{124}_9$) are formed when grid structure 130 is attached to support frame 120. While rectangular compartments are shown in this example, the disclosure is not limited to rectangular shaped compartments. In this regard, other shaped compartments may be used, provided that the other shaped compartments allow scattering members to interact with unsecured objects, causing the unsecured objects to collide with a bottom surface of the screening assembly to thereby cause debinding of the screening assembly.

Support frame 120 includes a first edge member $\mathbf{122}_1$, an opposing second edge member $\mathbf{122}_2$, a third edge member $\mathbf{122}_3$, and an opposing fourth edge member $\mathbf{122}_4$. The first plurality of support members (i.e., $\mathbf{128}_1$ to $\mathbf{128}_6$) may be configured to be mutually parallel and to be parallel to edge members $\mathbf{122}_1$ and $\mathbf{122}_2$. Similarly, the second plurality of support members (i.e., $\mathbf{126}_1$ and $\mathbf{126}_2$) may be configured to be mutually parallel and to be parallel to edge members $\mathbf{122}_3$ and $\mathbf{122}_4$. As is illustrated in FIG. 1, the first and second pluralities of support members may delimit various compartments of support frame 120. For example, the fifth compartment $\mathbf{124}_5$ may be delimited by slab $\mathbf{128}_2$, slab $\mathbf{128}_5$, a first portion of the bar $\mathbf{126}_1$, and a first portion of the bar $\mathbf{126}_2$.

Grid structure 130 may have openings arranged in a lattice (e.g., a square lattice or a rectangular lattice). As illustrated in FIG. 1, for example, grid structure 130 may be affixed (removably or essentially permanently) to a bottom portion of support frame 120. As such, grid structure 130 may serve as a support structure for the compartments (e.g., compartments $\mathbf{124}_1$ to $\mathbf{124}_9$) of support frame 120. The disclosure is not limited to metal grid structures 130. In some embodiments, grid structure 130 may include a perforated sheet having an arrangement of perforations that may be affixed to support frame 120. Grid structure 130, having the above-mentioned lattice of openings, is configured to support attachment of scattering members (as described below) and to confine the unsecured objects within the above-mentioned compartments, while allowing liquid medium and smaller particles (i.e., particles small enough to flow through openings of screening assembly 110) to flow through grid structure 130 and out of screening assembly 100.

FIG. 1 illustrates a first scattering member 134*a* and a second scattering member 134*b* attached to a portion of grid structure 130 within a boundary 136 of compartment $\mathbf{124}_5$. Boundary 136 is represented with a continuous line, defining a rectangular region, on grid structure 130 that forms a bottom surface to compartment $\mathbf{124}_5$. The first scattering member 134*a* may be placed at an angle with respect to a Cartesian axis (e.g., with respect to the x axis in FIG. 1), and the second scattering member 134*b* may be rotated about 90 degrees relative to the first scattering member. The disclosure is not limited to two scattering members nor is the disclosure limited to the arrangement illustrated in FIG. 1. Further arrangements may be provided in other embodiments.

FIG. 1 also illustrates an unsecured impact member 138 that may be incorporated into compartment $\mathbf{124}_5$, represented by the unsecured impact member 138 being placed within boundary 136. Unsecured impact member 138 may be a substantially cylindrically-symmetric solid having an opening or a through hole. As such, in some embodiments, the unsecured impact member 138 may be a solid having a substantially annular cross-section, for example, a substantially circular annulus or a substantially elliptical annulus. As an example, the substantially annular cross-section may have an outer diameter of about 41.3 mm and an inner diameter having a value in a range from about 10.3 mm to about 25.4 mm.

In other embodiments, unsecured impact member 138 may be a substantially spherical solid or a substantially ellipsoidal solid. A substantially circular cross-section of such an unsecured impact member 130 may have a diameter of about 41.3 mm. Regardless a specific shape, the unsecured impact member 138 may be made of a polymer and may have a mass in a range from about 23 g to about 46 g. The polymer may be or may include, for example, a rubber or a plastic. In some embodiments, the rubber may be silicone rubber, natural rubber, butyl rubber, nitrile rubber, neoprene rubber, a combination of the foregoing, etc.

According to various embodiments, a size, shape, mass, and morphology (e.g., with or without a through-hole) of unsecured impact members may be designed to optimize a collision rate of unsecured objects with scattering members and with the screen assembly. In this regard, for a given vibrational motion of the screening system, a collision rate of an unsecured object depends on its mass as well as its size relative to a size of the deblinding apparatus. Further, the mass of an unsecured object, for a given size and shape, may be reduced with the introduction of an opening or through hole, and thus the mass may be tuned as needed. The choice of material (e.g., rubber rather than metal, plastic, etc.) may also be optimized to provide deblinding while reducing a tendency for the unsecured objects to cause damage to the screen assembly through collisions with the screen assembly.

The disclosure is not limited to embodiments having a single unsecured impact member. Other embodiments may include more than one unsecured impact member. As mentioned above, compartments of support frame 120, confined on a side by grid structure 130, may contain different respective numbers of unsecured impact members.

As is illustrated in FIG. 1, respective portions of screen 130, included in screen assembly 110, cover respective compartments of support frame 120, wherein the respective portions face respective portions of grid structure 130. Further, unsecured impact member(s) disposed within a compartment of a deblinding apparatus may be configured to collide with at least one of the scattering member(s) also disposed within the compartment. Collisions may be caused by oscillations or other types of movements of support frame 120, for example, in a plane substantially parallel to the plane that contains grid structure 130. Collision of an unsecured impact member with a scattering member may cause the unsecured impact member to scatter and to thereby collide with a portion of the surface of the screen assembly 110 facing grid structure 130. Therefore, the unsecured impact member also may be configured to collide with the surface of screen assembly 110 in response to the oscillations of support frame 120.

In embodiments in which the screen assembly 110 includes a urethane screen having microstructures defining openings, unsecured impact members having shapes that include edges or vertices may potentially damage such microstructures. Therefore, unsecured impact members having substantially smooth surfaces may preserve the integrity of the urethane screen and therefore may be more desirable relative to impact members having edges or vertices. Embodiments of the disclosure, however, are not limited to solids having smooth surfaces.

Figure 2:
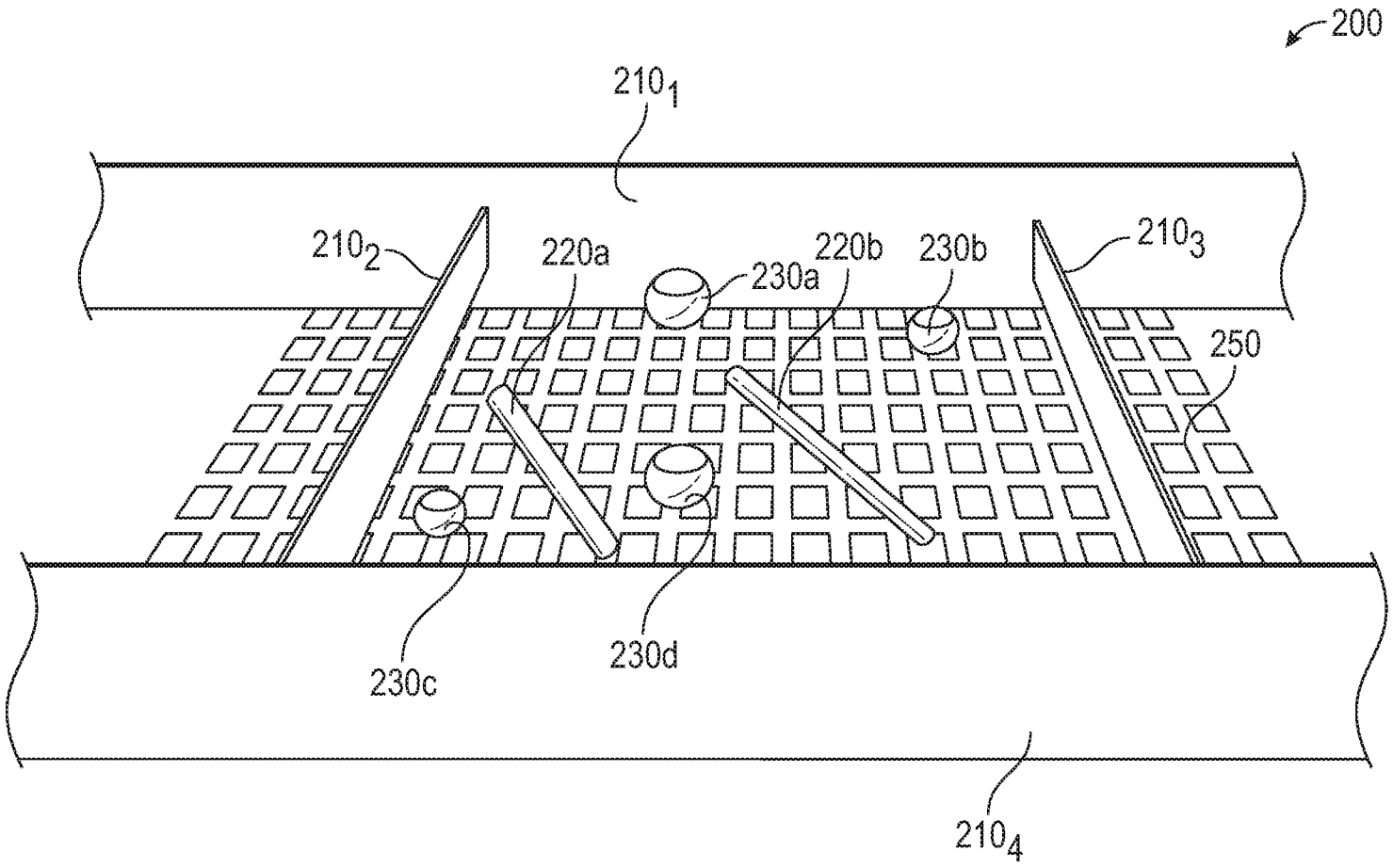
FIG. 2 presents a perspective view of a compartment within a deblinding apparatus, in accordance with one or more embodiments of the disclosure.

FIG. 2 presents a perspective view of a compartment 200 within a deblinding apparatus, in accordance with one or more embodiments of the disclosure. In some embodiments, compartment 200 may correspond to one or more of the compartments, $\mathbf{124}_1$ to $\mathbf{124}_9$, in the deblinding apparatus formed by support frame 120 and grid structure 130. Compartment 200 includes a first bar $\mathbf{210}_1$ and an opposing second bar $\mathbf{210}_4$, where the first bar $\mathbf{210}_1$ and the second bar $\mathbf{210}_4$ may be configured to be substantially parallel to one another. Compartment 200 also includes a first slab $\mathbf{210}_2$ and an opposing second slab $\mathbf{210}_3$, where the first slab $\mathbf{210}_1$ and the second bar $\mathbf{210}_4$ may be configured to be substantially parallel to one another.

A first end and a second end of the first slab $\mathbf{210}_2$ may be abutted against the first bar $\mathbf{210}_1$ and the second bar $\mathbf{210}_4$, respectively. Further, a first end and a second end of the second slab $\mathbf{210}_3$ may be abutted against the first bar $\mathbf{210}_1$ and the second bar $\mathbf{210}_4$, respectively. A portion of the first bar $\mathbf{210}_1$, a portion of the second bar $\mathbf{210}_4$, the first slab $\mathbf{210}_2$, and the second slab $\mathbf{210}_3$, may form respective sidewalls of compartment 200. The spatial relationships among such sidewalls result in a rectangular compartment. As mentioned above, the disclosure is not limited in that respect and other sidewalls may be assembled to form a compartment having other shapes.

A portion of a grid structure 250 forms a bottom surface of compartment 200. Grid structure 250 may be a wire mesh, a metal grid, a plastic grid, a composite material grid, and may be affixed to the first bar $\mathbf{210}_1$ and to the second bar $\mathbf{210}_4$. In some embodiments, grid structure 250 may represent grid structure 130 in the screening system having a deblinding apparatus 100 illustrated in FIG. 1. The portion of grid structure 250 may permit assembly of one or more scattering members associated with the compartment 200. For example, in one embodiment, a first scattering member 220*a* and a second scattering member 220*b* may be removably affixed to the portion of grid structure 250. In this regard, one or more first openings of the portion of grid structure 250 may be configured (e.g., manufactured to have a specified size) to receive respective one or more first fastening members (e.g., pin(s), bolt(s), etc.) of the first scattering member 220*a*. In other aspects, one or more second openings of the portion of grid structure 250 also may be configured to receive respective one or more second fastening members (e.g., pin(s), bolt(s), etc.) of the second scattering member 220*b*.

Multiple unsecured impact members including unsecured impact member 230*a*, unsecured impact member 230*b*, unsecured impact member 230*c*, and unsecured impact member 230*d*, may be disposed within compartment 200. Unsecured impact members 230*a* to 230*d* may each be a solid having substantially cylindrical symmetry with respect to a longitudinal axis of a through hole in the solid (not shown). Similarly to other impact members described above, unsecured impact members 230*a* to 230*d* may have a substantially annular cross-section having an outer diameter of about 41.30 mm and an inner diameter having a value in a range from about 10.3 mm to about 25.4 mm.

While unsecured impact members 230*a* to 230*d* of FIG. 2 are illustrated as substantially cylindrically symmetric with respect to an axis along a through hole, further embodiments may include other morphologies. Accordingly, in other embodiments, an unsecured impact member (e.g., unsecured impact members 230*a* to 230*d*) may be a substantially spherical solid or a substantially ellipsoidal solid. A substantially circular cross-section of such an unsecured impact member may have a diameter of about 41.30 mm. As mentioned above, regardless a specific shape, unsecured impact member 138 may be made of a polymer and may have a mass in a range from about 23 g to about 46 g. The polymer may be, for example, a rubber or a plastic. In some embodiments, the rubber may be a silicone rubber, natural rubber, butyl rubber, nitrile rubber, neoprene rubber, a combination of the foregoing, etc.

Figure 3:
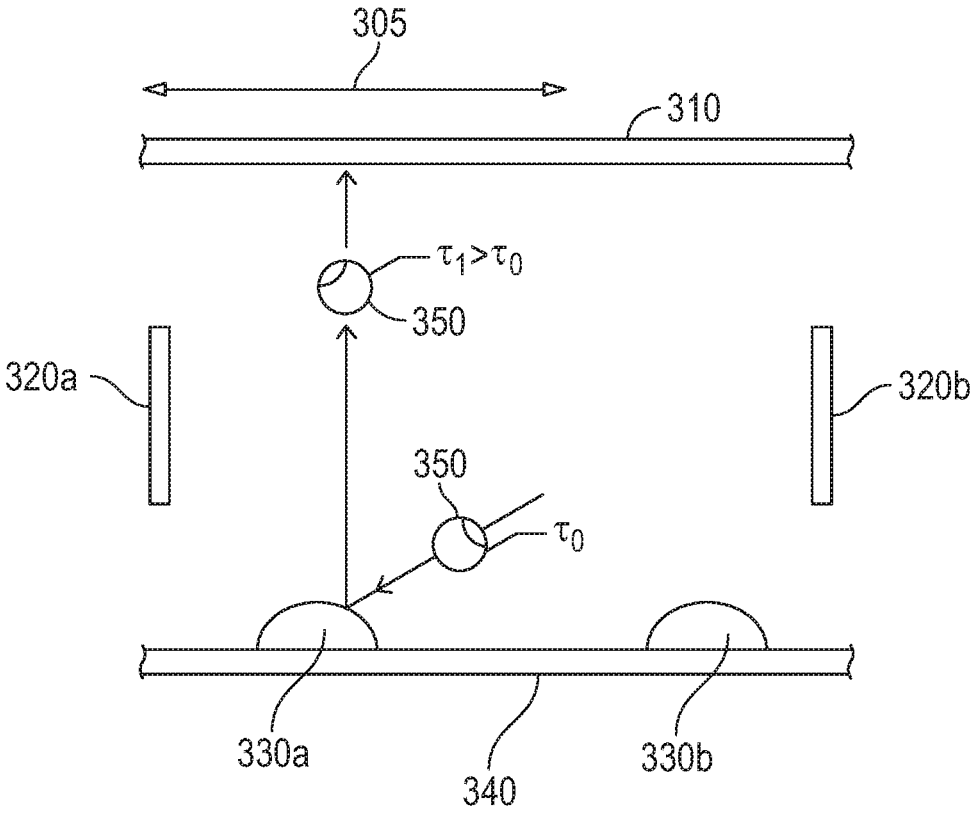
FIG. 3 presents a schematic diagram of collisions within a screening system having a deblinding apparatus, in accordance with one or more embodiments of the disclosure.

FIG. 3 presents a schematic diagram of collisions within a screening system having a deblinding apparatus (e.g., screening system having a deblinding apparatus 100), in accordance with one or more embodiments of the disclosure. FIG. 3 represents a cross-section of a compartment (e.g., compartment $\mathbf{124}_5$ or compartment 200 of FIGS. 1 and 2, respectively) within the screening system having a deblinding apparatus, where the compartment includes at least a first scattering member 330*a* and a second scattering member 330*b*. The screening system having a deblinding apparatus may be caused to oscillate within a plane or to otherwise vibrate. For instance, the screening system having a deblinding apparatus may be coupled to a motor that causes the structure to oscillate or otherwise vibrate.

The oscillation or vibration is represented in FIG. 3 with a double-headed arrow 305. At a time $\Sigma<\tau_0$, the oscillation or movement may cause an unsecured impact member 350 to collide with an element of the compartment (e.g., sidewall 320*b*). Such a collision may cause the unsecured impact member 350 to travel towards the first scattering member 330*a*. The unsecured impact member 350 may collide with the scattering member 330*a* at an instant $\tau'>\tau_0$, and scatter towards a portion of a screen assembly 310 (e.g., a urethane screen). Thus, the scattering member 330*a* may cause the unsecured impact member 350 to travel towards screen assembly 310 and to collide with screen assembly 310. As mentioned above, compartments in a deblinding apparatus may have respective numbers of unsecured impact members.

Figure 4A:
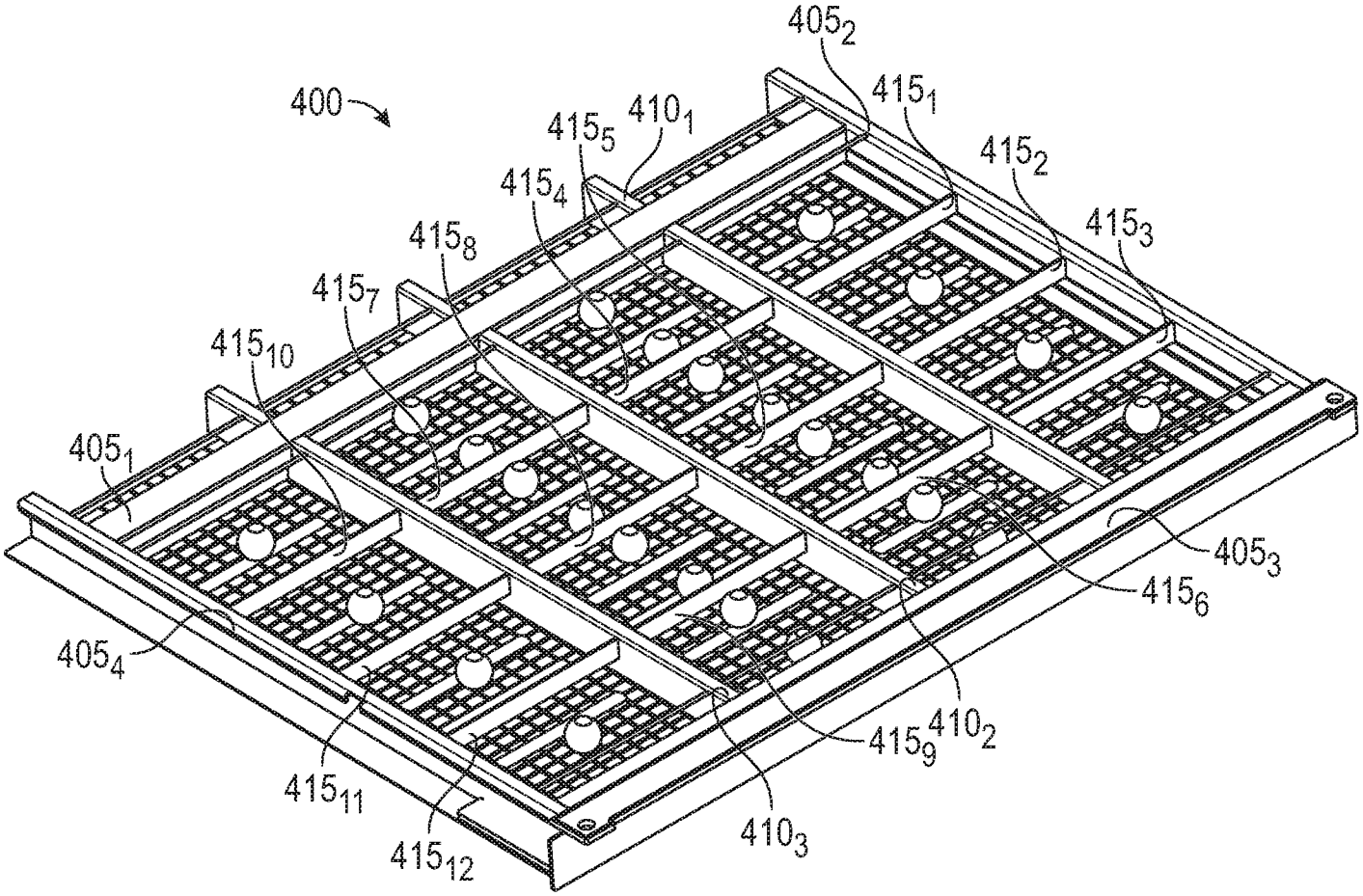
FIG. 4A presents an isometric view of a deblinding apparatus, in accordance with one or more embodiments of the disclosure.

FIG. 4A presents an isometric view of a deblinding apparatus 400, in accordance with one or more embodiments of the disclosure. Deblinding apparatus 400 includes a first edge member $\mathbf{405}_1$, an opposing second edge member $\mathbf{405}_3$, a third edge member $\mathbf{405}_2$, and an opposing fourth edge member $\mathbf{405}_4$. Deblinding apparatus 400 also includes a first bar $\mathbf{410}_1$, a second bar $\mathbf{410}_2$, and a third bar $\mathbf{410}_3$, configured to be substantially parallel to one another. Each of the first bar $\mathbf{410}_1$, the second bar $\mathbf{410}_2$, and the third bar $\mathbf{410}_3$, may be straight and may extend between edge member $\mathbf{405}_1$ and edge member $\mathbf{405}_3$. Further, deblinding apparatus 400 also includes multiple slabs that permit forming, at least in part, the compartments of the deblinding apparatus 400. The multiple slabs include slabs $\mathbf{415}_1$ to $\mathbf{415}_{12}$, and deblinding apparatus 400 includes sixteen compartments.

Each of the compartments of deblinding apparatus 400 has a respective number of unsecured impact members. A subset of eight of the compartments includes compartments having a single unsecured impact member, and another subset of eight compartments includes compartments having two unsecured impact members. While each of the unsecured impact members is a substantially cylindrically-symmetric solid having a through hole, the disclosure is not so limited and other embodiments may include other solid objects having different shapes.

Figure 4B:
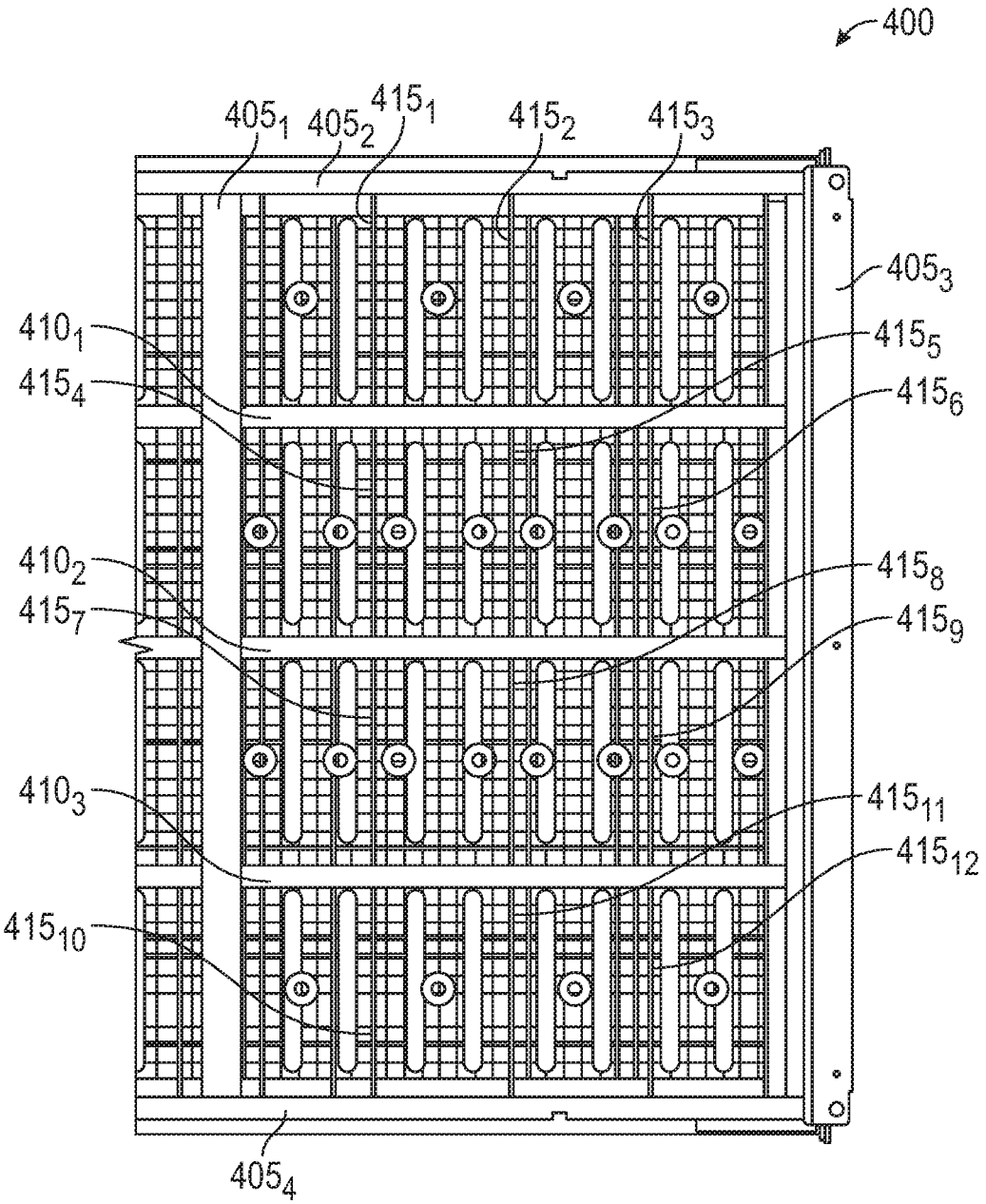
FIG. 4B presents a top view of the deblinding apparatus shown in FIG. 4A, in accordance with one or more embodiments of the disclosure.

FIG. 4B presents a top view of the example deblinding apparatus 400 of FIG. 4A, in accordance with one or more embodiments of the disclosure. Each of the compartments in deblinding apparatus 400 includes two scattering members. Each of the scattering members may be a strip that protrudes from a surface of the grid structure that forms a support structure for the compartments. The scattering members in each compartment may be removably affixed to the grid structure, and may be configured to be substantially parallel to one another. Each scattering member in deblinding apparatus 400 is configured to be substantially parallel to the first edge member $\mathbf{405}_1$ and to the opposing second edge member $\mathbf{405}_3$.

Figure 4C:
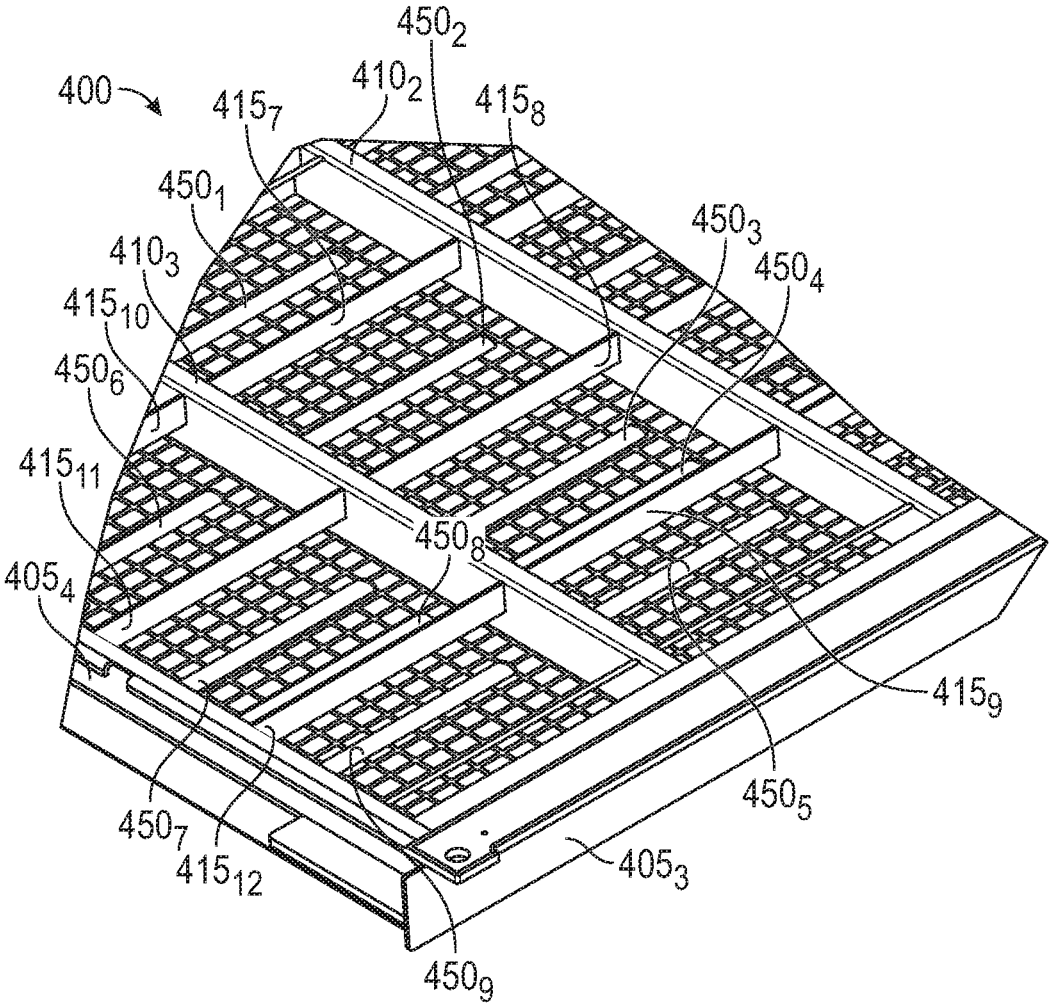
FIG. 4C presents an isometric view of a portion of a deblinding apparatus, in accordance with one or more embodiments of the disclosure.

FIG. 4C presents an isometric view of a portion of deblinding apparatus 400, in accordance with one or more embodiments of the disclosure. A subset of scattering members including scattering member $\mathbf{450}_1$, scattering member $\mathbf{450}_2$, scattering member $\mathbf{450}_3$, scattering member $\mathbf{450}_4$, scattering member $\mathbf{450}_5$, scattering member $\mathbf{450}_6$, scattering member $\mathbf{450}_7$, scattering member $\mathbf{450}_8$, and scattering member $\mathbf{450}_9$, is shown. As mentioned above, scattering members within a deblinding apparatus may be removably affixed to a grid structure, such as a metal grid structure, a plastic grid structure, a composite material structure, etc.

Figure 5A:
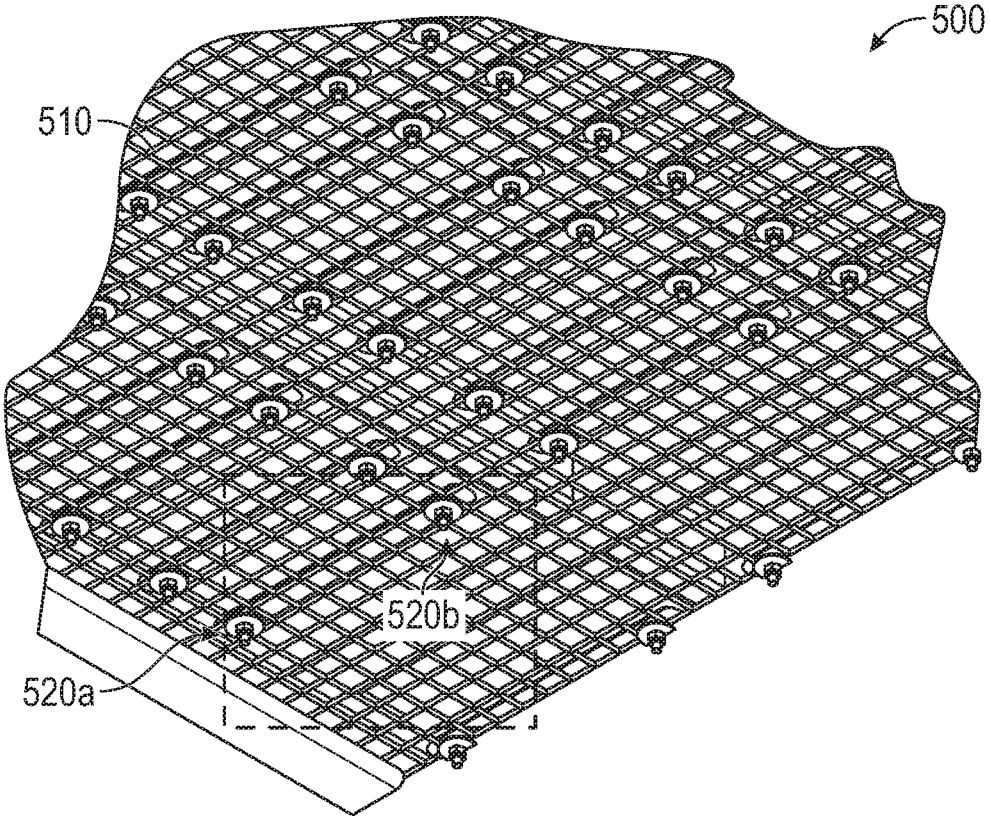
FIG. 5A presents an isometric view of a portion of a deblinding apparatus, in accordance with one or more embodiments of the disclosure.

FIG. 5A presents an isometric view of a portion of a deblinding apparatus 500, in accordance with one or more embodiments of the disclosure. Multiple scattering members may be removably affixed to a grid structure 510. In this regard, multiple scattering members may include a first fastening arrangement 520*a* and a second fastening arrangement 520*b*.

Figure 5B:
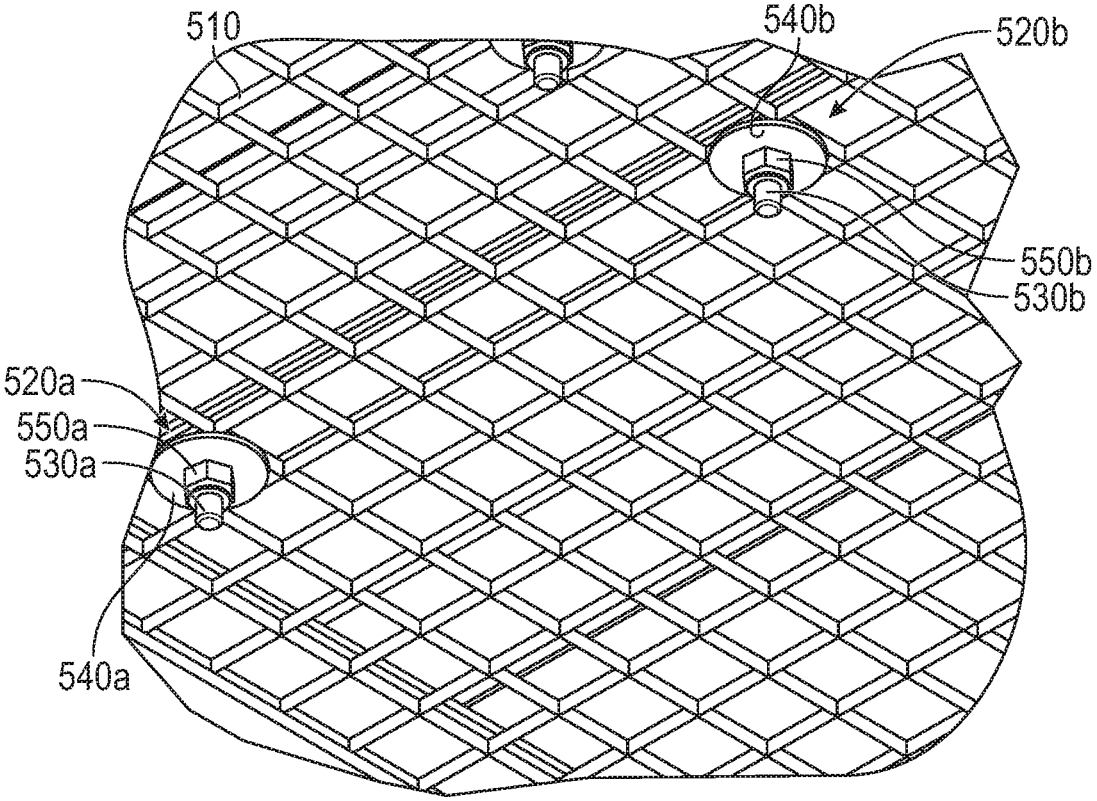
FIG. 5B presents an isometric view of a portion of the deblinding apparatus shown in FIG. 5A, in accordance with one or more embodiments of the disclosure.

As illustrated in FIG. 5B, in some embodiments, multiple scattering members may include a first threaded protrusion 530*a* (e.g., a threaded bolt) configured to fit through a first opening in a portion of grid structure 510, and a second threaded protrusion 530*b* (e.g., a threaded bolt) configured to fit through a second opening in the portion of grid structure 510. The first threaded protrusion 530*a* may be configured to receive a first fastening arrangement 520*a*. In some embodiments, the first fastening arrangement 520*a* includes a washer member 540*a* and a fastening member 550*a* (e.g., a threaded nut).

The fastening member 550*a* may be configured to abut the washer member 540*a* against a region of the portion of grid structure 510 that is proximate to the first opening. Further, the second threaded protrusion 530*b* may be configured to receive the second fastening arrangement 520*b*. In some embodiments, the second fastening arrangement includes a washer member 540*b* and a fastening member 550*b* (e.g., a threaded nut) configured to abut the washer member 540*b* against a region of the portion of grid structure 510 that is proximate to the second opening.

Figure 6:
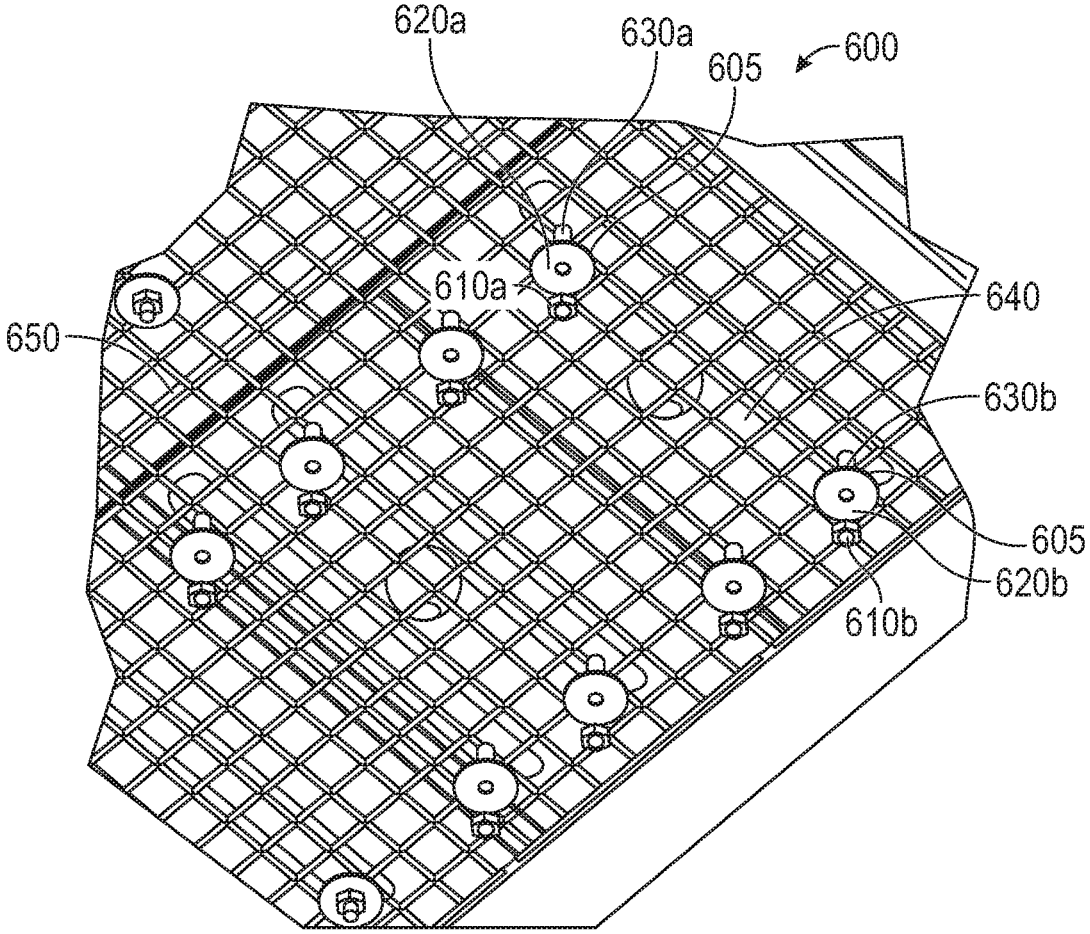
FIG. 6 presents a view of a portion of a deblinding apparatus, in accordance with one or more embodiments of the disclosure.

FIG. 6 presents a view of multiple fastening arrangements of respective multiple scattering members in a deblinding apparatus 600, in accordance with one or more embodiments of the disclosure. Multiple fastening arrangements may include a washer member and a fastening member, such as a threaded nut, a butterfly nut, etc. For example, deblinding apparatus 600 includes a grid structure 650 (e.g., a metal grid structure, a plastic grid structure, or a grid structure made of a composite material).

As illustrated in FIG. 6, for example, several scattering members may be removably affixed to grid structure 650. A scattering member 605 includes a first threaded protrusion 630*a* and a second threaded protrusion 630*b* configured to fit through respective openings of grid structure 650. The first threaded protrusion 630*a* is configured to receive a first fastening arrangement including a washer member 620*a* and a fastening member 610*a* that may engage the first threaded protrusion 630*a*. The second threaded protrusion 630*b* is configured to receive a second fastening arrangement including a washer member 620*b* and a fastening member 610*b* that may engage the first threaded protrusion 630*a*.

Figure 7A:
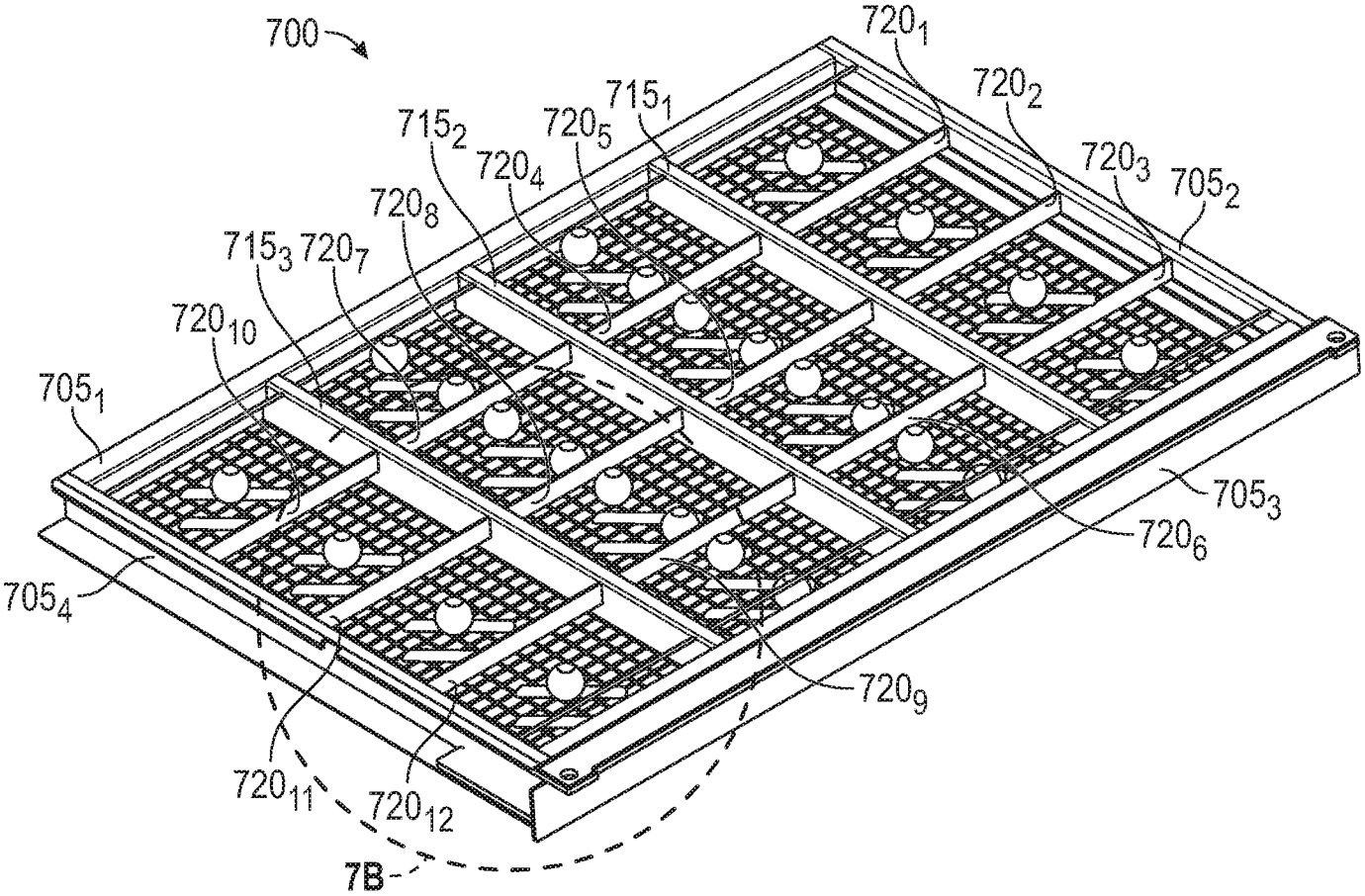
FIG. 7A presents an isometric view of a deblinding apparatus, in accordance with one or more embodiments of the disclosure.

FIG. 7A presents an isometric view of a deblinding apparatus 700, in accordance with one or more embodiments of the disclosure. The deblinding apparatus 700 includes a first edge member $\mathbf{705}_1$, an opposing second edge member $\mathbf{705}_3$, a third edge member $\mathbf{705}_2$, and an opposing fourth edge member $\mathbf{705}_4$. Deblinding apparatus 700 also includes a first bar $\mathbf{715}_1$, a second bar $\mathbf{715}_2$, and a third bar $\mathbf{715}_3$, configured to be substantially parallel to one another. Each of the first bar $\mathbf{715}_1$, the second bar $\mathbf{715}_2$, and the third bar $\mathbf{715}_3$, may be substantially straight and may extend between the first edge member $\mathbf{705}_1$ and the opposing second edge member $\mathbf{705}_3$.

Deblinding apparatus 700 may also include multiple slabs that permit forming, at least in part, compartments of the deblinding apparatus 700. In this example, multiple slabs include slabs $\mathbf{720}_1$ to $\mathbf{720}_{12}$, which delimit sixteen compartments. As is illustrated, each one of such compartments includes two scattering members configured to be substantially parallel to one another and oriented at an angle relative to edge member $\mathbf{705}_3$. Further, in this example, each compartment of a subset of eight of the compartments includes a single unsecured impact member, and each compartment of another subset of eight compartments includes two unsecured impact members. While each of the unsecured impact members is a substantially cylindrically-symmetric solid having a through hole, the disclosure is not so limited and other embodiments may include other solid objects of various shapes.

Figure 7B:
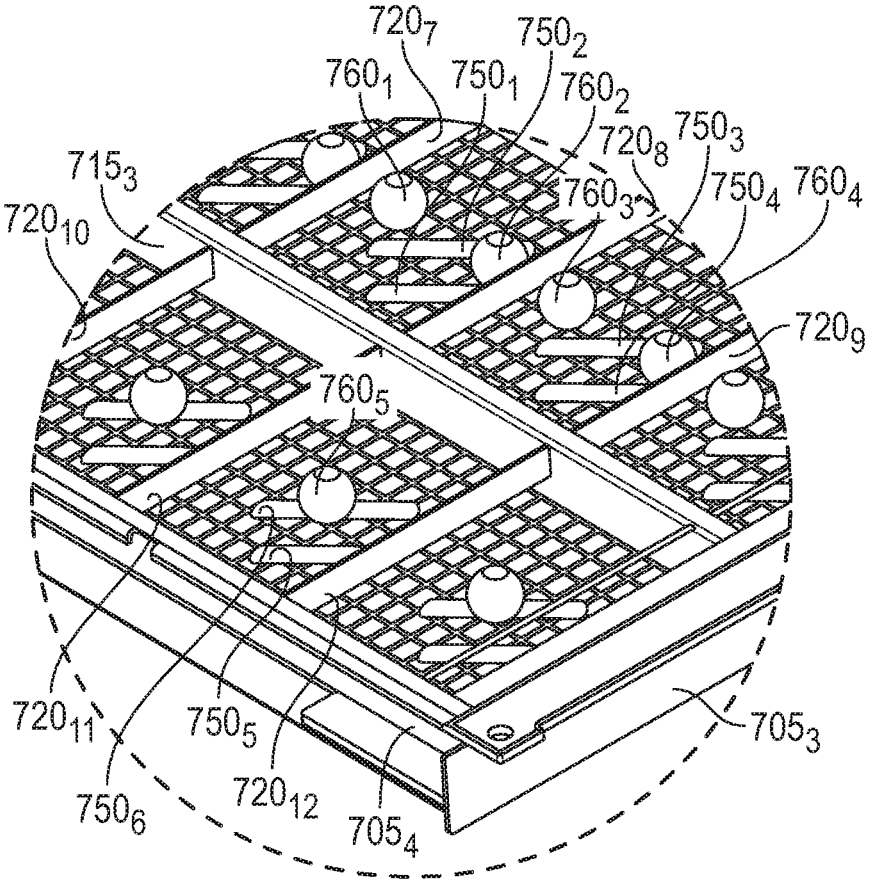
FIG. 7B presents an isometric view of a portion of the deblinding apparatus shown in FIG. 7A, in accordance with one or more embodiments of the disclosure.

FIG. 7B presents an isometric view of a portion of the deblinding apparatus 700 shown in FIG. 7A, in accordance with one or more embodiments of the disclosure. A first compartment may include a scattering member $\mathbf{750}_1$, a scattering member $\mathbf{750}_2$, an unsecured impact member $\mathbf{760}_1$, and an unsecured member $\mathbf{760}_2$. A second compartment, adjacent to the first compartment, may include a scattering member $\mathbf{750}_3$, a scattering member $\mathbf{750}_4$, an unsecured impact member $\mathbf{760}_3$, and an unsecured member $\mathbf{760}_4$. A third compartment, which is adjacent the second compartment, may include a scattering member $\mathbf{750}_5$, a scattering member $\mathbf{750}_6$, and an unsecured impact member $\mathbf{760}_5$.

FIGS. 8A to 8D present top views of example arrangements of scattering members within a deblinding apparatus, in accordance with one or more embodiments of the disclosure. In an arrangement 800 shown in FIG. 8A, a first scattering member 814*a* and a second scattering member 814*b* are configured to be substantially parallel to one another within a portion 810 of a grid structure. As mentioned above, the grid structure may be, or may include, a metal grid structure, a plastic grid structure, etc. Each one of first scattering member 814*a*, and the second scattering member 814*b*, may be, or may include, an elongated strip. The first scattering member 814*a* and the second scattering member 814*b* are oriented at an angle relative to an edge (e.g., along the x axis) of the portion 810.

Figure 8A:
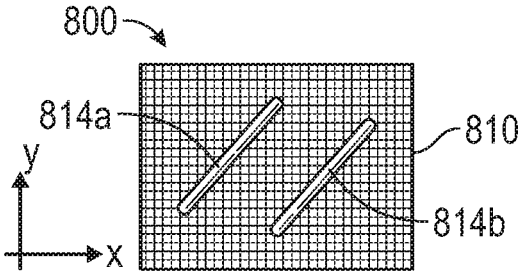
FIG. 8A presents a top view of an arrangement of scattering members within a deblinding apparatus, in accordance with one or more embodiments of the disclosure.
Figure 8B:
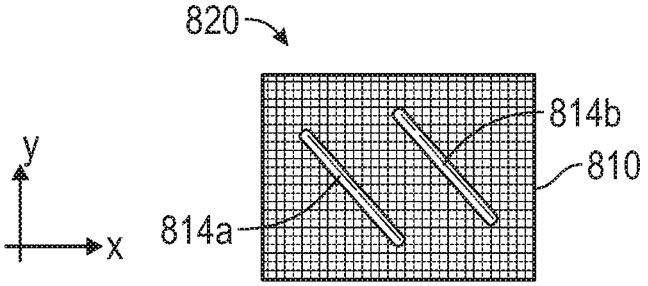
FIG. 8B presents a top view of an arrangement of scattering members within a deblinding apparatus, in accordance with one or more embodiments of the disclosure.

In an arrangement 820, shown in FIG. 8A, the first scattering member 814*a* and the second scattering member 814*b* may also be configured to be substantially parallel to one another within portion 810 of the grid structure. The first scattering member 814*a* and the second scattering member 814*b* are oriented at a second angle relative to an edge (e.g., along the x axis) of portion 810, and may be rotated about 90 degrees relative to the orientation in the arrangement 800.

Figure 8C:
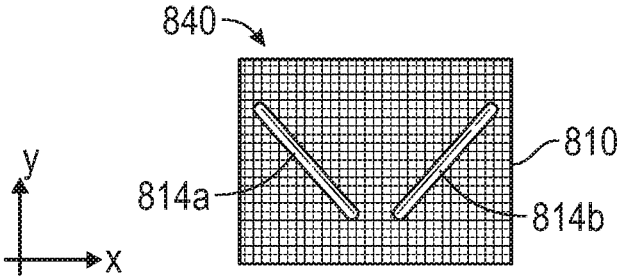
FIG. 8C presents a top view of an arrangement of scattering members within a deblinding apparatus, in accordance with one or more embodiments of the disclosure.

As is illustrated, for example in arrangement 840, shown in FIG. 8C, the first scattering member 814*a* and the second scattering member 814*b* need not be configured to be substantially parallel to one another within the portion 810 of the grid structure. The first scattering member 814*a* may be configured to be oriented at a first angle relative to an edge of the portion 810 (e.g., along the x axis), and the second scattering member 814*b* may be configured to be oriented at a second angle relative to such an edge. Scattering members in different compartments of a deblinding apparatus may be assembled in different arrangements.

Figure 8D:
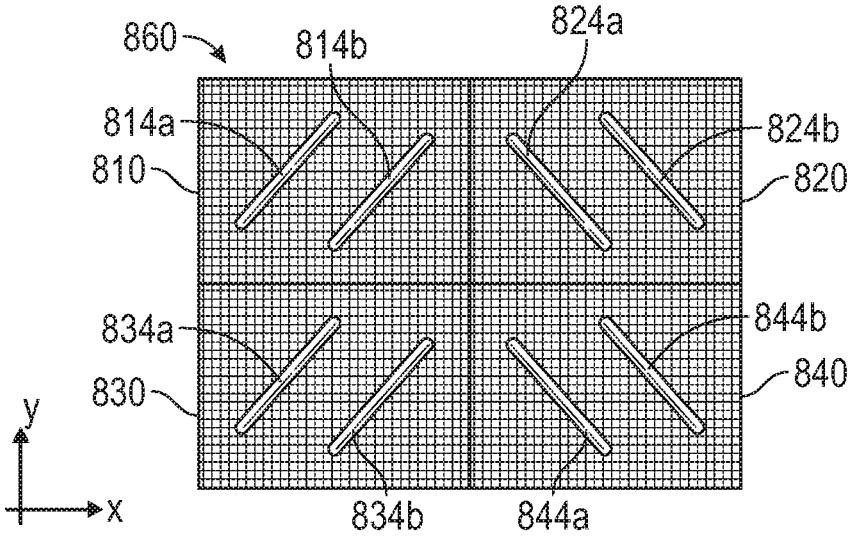
FIG. 8D presents a top view of an arrangement of scattering members within a deblinding apparatus, in accordance with one or more embodiments of the disclosure.

FIG. 8D illustrates an arrangement 860, which spans four adjacent portions 810, 820, 830, and 840 of a grid structure (e.g., grid structure 130 or grid structure 250 of FIGS. 1 and 2, respectively), which serves as a support structure for respective compartments of the deblinding apparatus. In each portion, scattering members may be configured to be substantially parallel to one another. For example, scattering member 814*a* and scattering member 814*b* may be configured to be substantially parallel to one another within portion 810. Scattering member 824*a* and scattering member 824*b* may be configured to be substantially parallel to one another within portion 820. Scattering member 834*a* and scattering member 834*b* may be configured to be substantially parallel to one another within portion 830. Scattering member 844*a* and scattering member 844*b* may be configured to be substantially parallel to one another within portion 840.

The orientation of the scattering members in a first portion of the grid structure may be rotated relative to another orientation of other scattering members in another portion of the grid structure. For example, scattering members 824*a* and 824*b* may be rotated relative scattering members 814*a* and 814*b*. Likewise, scattering members 834*a* and 834*b* may be rotated relative to scattering members 824*a* and 824*b*. Similarly, scattering members 844*a* and 844*b* may be rotated relative to scattering member 834*a* and 834*b*.

Figure 9:
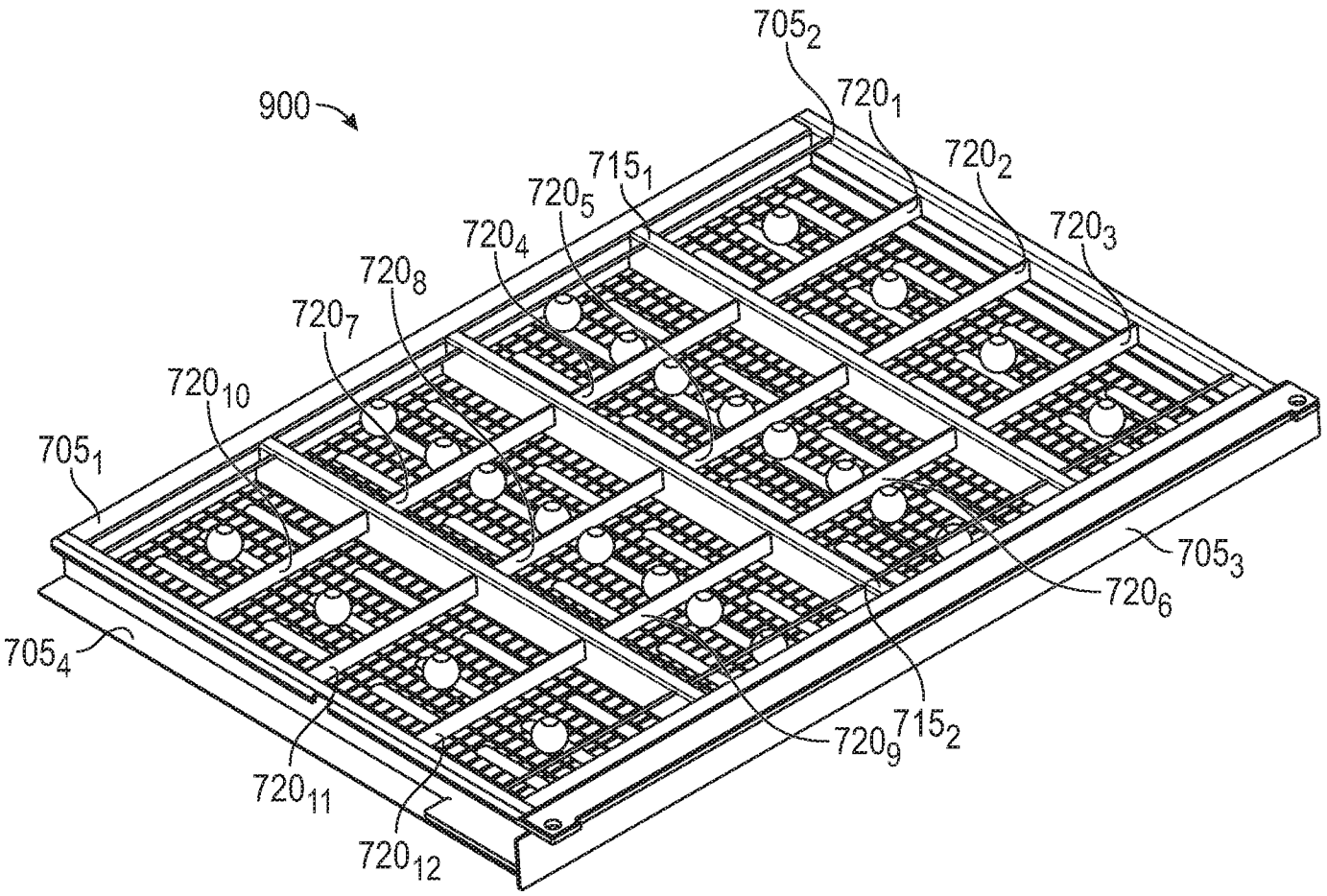
FIG. 9 presents an isometric view of a deblinding apparatus, in accordance with one or more embodiments of the disclosure.

FIG. 9 presents an isometric view of a deblinding apparatus 900, in accordance with one or more embodiments of the disclosure. Example deblinding apparatus 900 is similar to deblinding apparatus 700 illustrated in FIG. 7A. Each compartment of deblinding 900 apparatus includes a number of multiple scattering members that is greater than the number of scattering members in each compartment of deblinding apparatus 700. In this example, three scattering members are assembled in each compartment of deblinding apparatus 900, in contrast to deblinding apparatus 700 that has two scattering members. In this example, the multiple scattering members of deblinding apparatus 900 may be configured to be substantially parallel to one another and to be substantially parallel to a first edge member (e.g., edge member $\mathbf{705}_2$) of deblinding apparatus 900.

The multiple compartments of deblinding apparatus 900 include respective numbers of unsecured impact members. Each compartment in a first subset of the multiple compartments may include a single unsecured impact member, and each compartment in a second subset of the multiple compartments may include two unsecured impact members. While the configuration of unsecured impact members in deblinding apparatus 900 is similar to the other configuration of unsecured impact members in deblinding apparatus 700 (e.g., shown in FIG. 7A), the greater number of scattering members in deblinding apparatus 900 may increase a rate of collisions between an unsecured impact member and a screen assembly that may be attached to deblinding apparatus 900.

Figure 10:
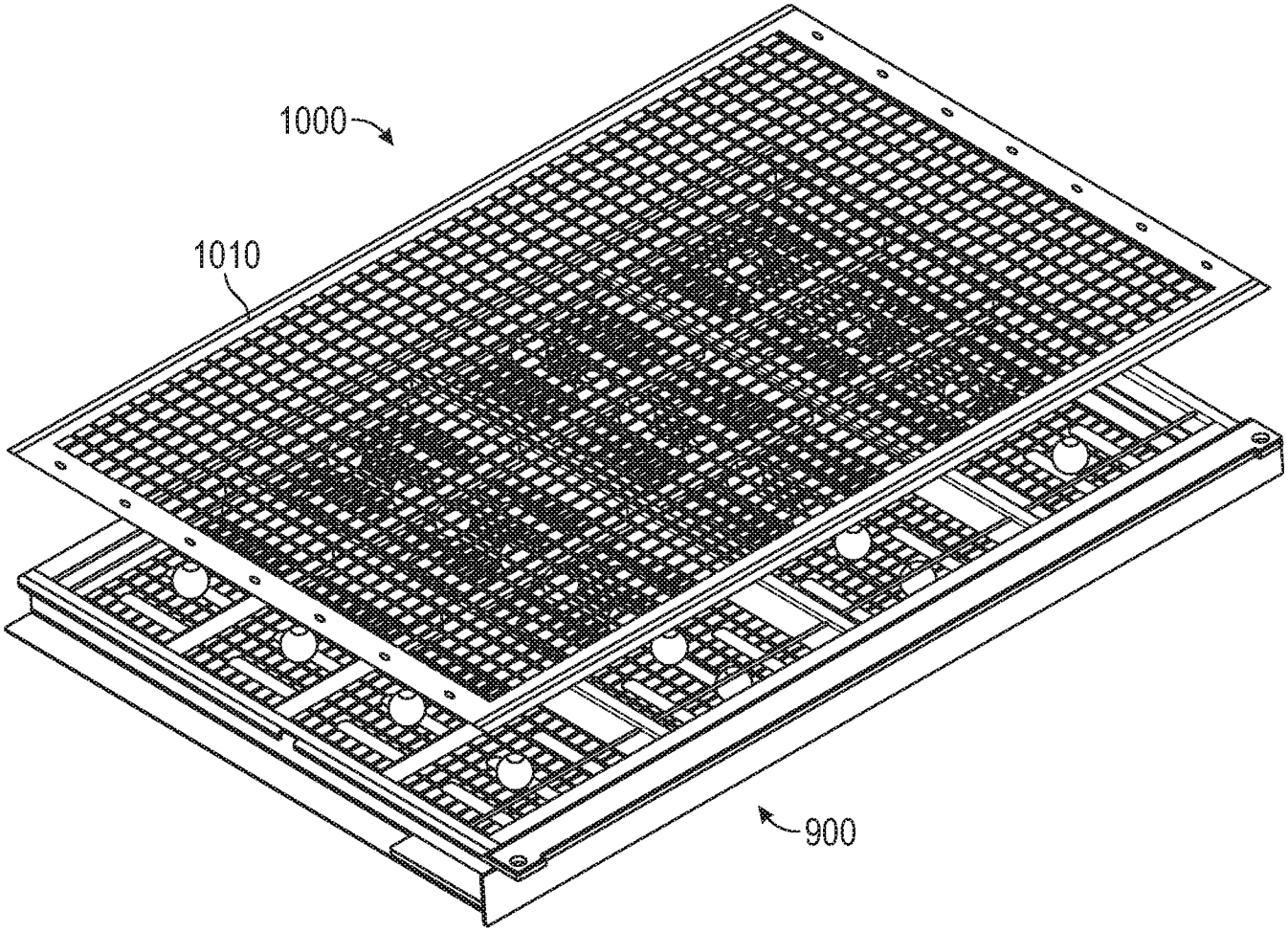
FIG. 10 presents an isometric exploded view of a screening system having a deblinding apparatus, in accordance with one or more embodiments of the disclosure.

FIG. 10 presents an isometric exploded view of a screening system having a deblinding apparatus 1000, in accordance with one or more embodiments of the disclosure. Screening system having deblinding apparatus 1000 may include a screen assembly 1010 and deblinding apparatus 900 (e.g., as shown in FIG. 9). Sections of the screen assembly 1010 that cover respective compartments having multiple unsecured impact members may encounter collisions with the multiple unsecured impact members at a first collision rate. Other sections of the screen assembly 1010 that cover respective compartments having a single unsecured impact member may encounter collisions with the single unsecured impact member at a second collision rate that is less than the first rate of collisions.

Scattering members contained in a compartment of a deblinding apparatus are not limited to elongated members. In some embodiments, more symmetric scattering members may be assembled within a grid structure that serves as a support structure for compartments included in the deblinding apparatus, as described in greater detail below.

FIGS. 11A to 11D present top views of example arrangements of scattering members having a substantially circular base, in accordance with one or more embodiments of the disclosure. In arrangement 1100, shown in FIG. 11A, a first scattering member 1110*a* and a second scattering member 1110*b* may be placed proximate to respective corners along a diagonal of a rectangular portion 1115 of a grid structure, in accordance with embodiments of the disclosure.

Figure 11A:
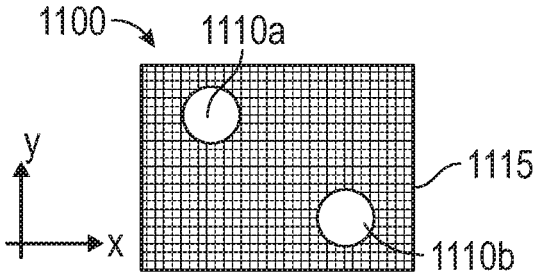
FIG. 11A presents a top view of an arrangement of scattering members within a deblinding apparatus, in accordance with one or more embodiments of the disclosure.
Figure 11B:
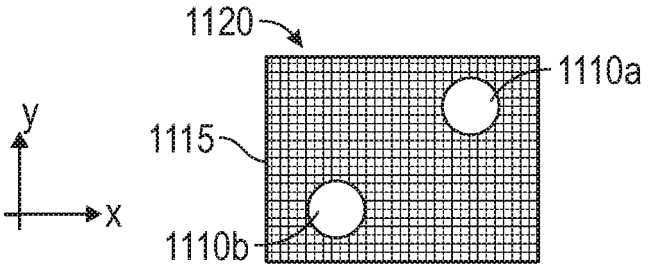
FIG. 11B presents a top view of an arrangement of scattering members within a deblinding apparatus, in accordance with one or more embodiments of the disclosure.

FIG. 11B shows an arrangement 1120 that includes the first scattering member 1110*a* and the second scattering member 1110*b* placed proximate to respective corners along a second diagonal of the rectangular portion 1115.

Figure 11C:
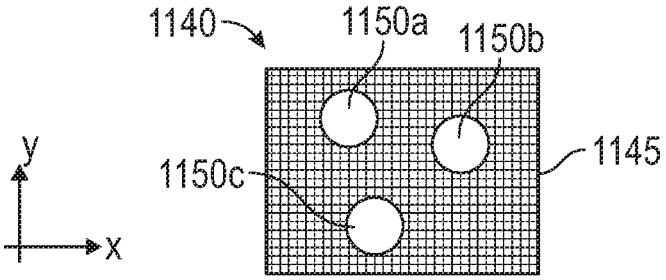
FIG. 11C presents a top view of an arrangement of scattering members within a deblinding apparatus, in accordance with one or more embodiments of the disclosure.
Figure 11D:
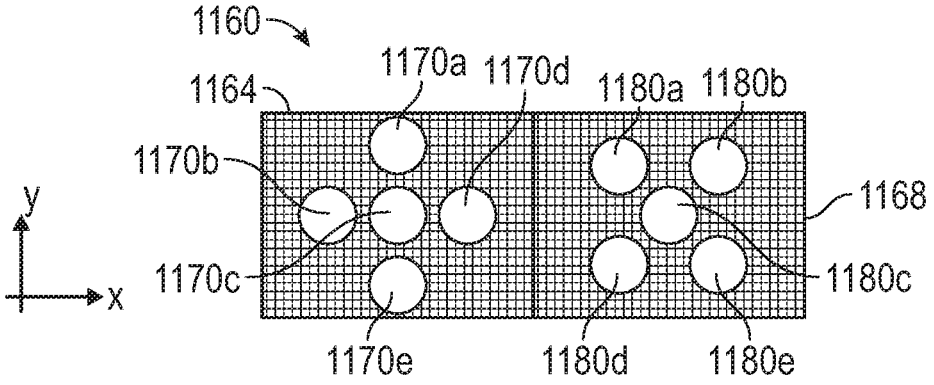
FIG. 11D presents a top view of an arrangement of scattering members within a deblinding apparatus, in accordance with one or more embodiments of the disclosure.
Figure 11E:
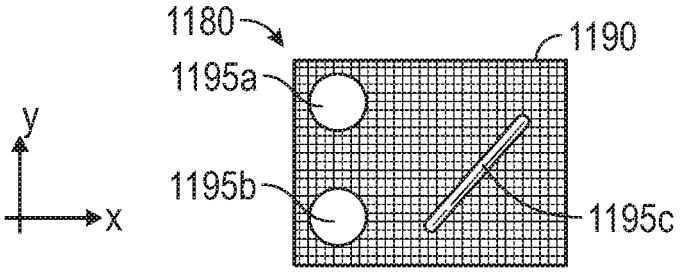
FIG. 11E presents a top view of an arrangement of scattering members within a deblinding apparatus, in accordance with one or more embodiments of the disclosure.

FIGS. 11C to 11E illustrates arrangements having a greater number of scattering members. FIG. 11C, for example, illustrates an arrangement 1140 having a first scattering member 1150*a*, a second scattering element 1150*b*, and a third scattering element 1150*c*, distributed randomly on a portion 1145 of the grid structure.

FIG. 11D illustrates another arrangement 1160 that includes different numbers of scattering members in different portions of the grid structure. For example, a first scattering member 1170*a*, a second scattering member 1170*b*, a third scattering member 1170*c*, a fourth scattering member 1170*d*, and a fifth scattering member 1170*e*, may be arranged in a design within a first portion 1164 of the grid structure. The design may have a group of symmetries. For instance, as is illustrated, such five scattering members may be arranged in a design having a $C_4$ symmetry axis (e.g., the z axis normal to the x, y axes) and $D_4$ symmetry group. Further, in a portion 1168 adjacent portion 1164, arrangement 1160 may include a first scattering member 1180*a*, a second scattering member 1180*b*, a third scattering member 1180*c*, a fourth scattering member 1180*d*, and a fifth scattering member 1180*e*, arranged in a second design having a group of symmetries. The second design may be obtained from a 45 degree rotation about the $C_4$ symmetry axis.

FIG. 11E presents an arrangement 1180 having a combination of different types of scattering members assembled within a portion 1190 of the grid structure. In such an arrangement, a first scattering member 1195*a* and a second scattering member 1195*b* each have a substantially circular base and are arranged proximate to respective corners of portion 1190. Further, a third scattering member 1195*a* is elongated and arranged at an angle relative to an edge of portion 1190.

As mentioned above, a number and/or an arrangement of scattering members within a deblinding apparatus may be adjusted based on various factors including, for example, the type of material to be sifted or separated. In some embodiments, scattering members may be assembled in a subset of the compartments of a deblinding apparatus, rather than in each compartment of the deblinding apparatus, as shown in FIG. 12A.

Figure 12A:
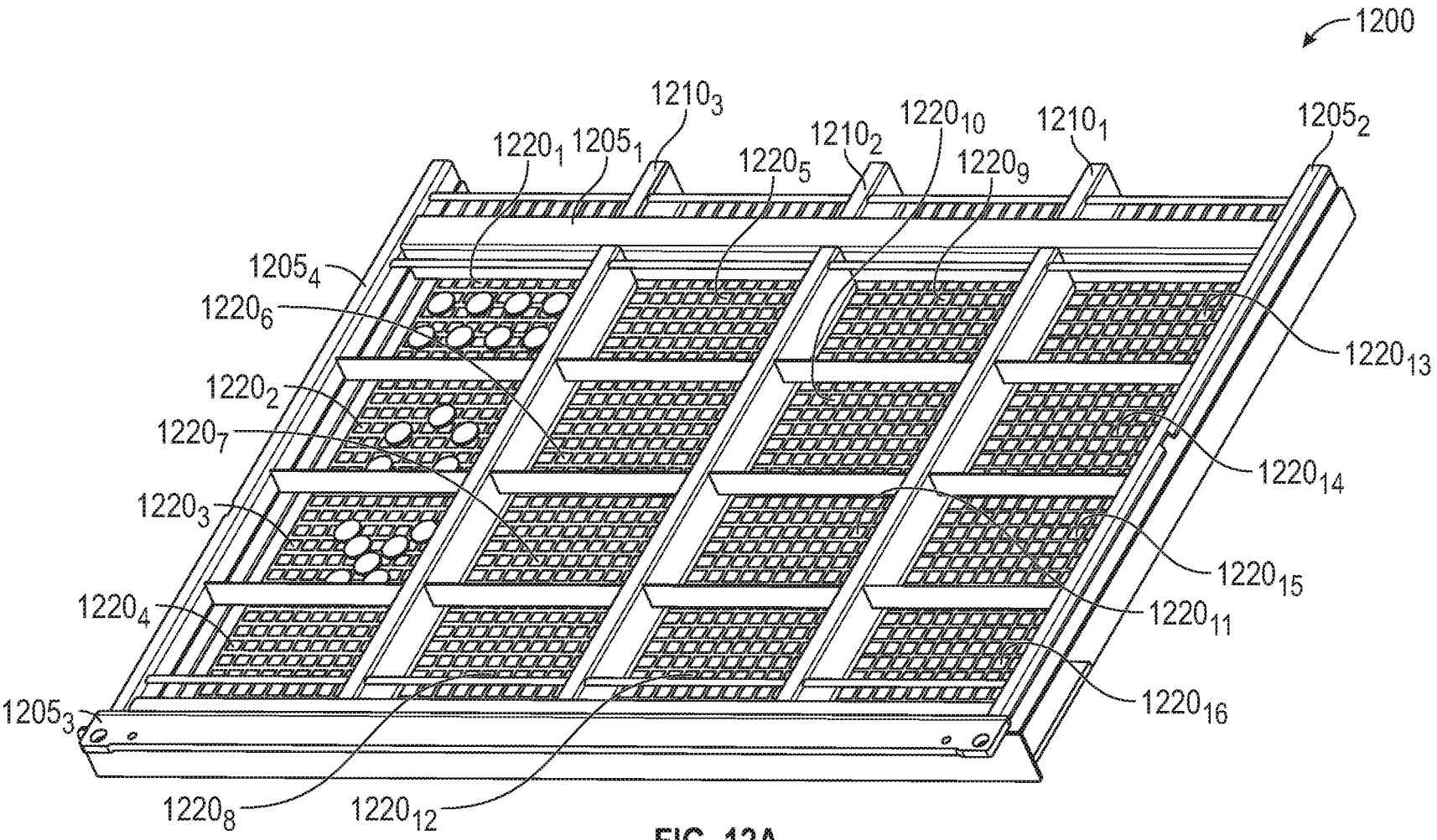
FIG. 12A presents an isometric view of a deblinding apparatus, in accordance with one or more embodiments of the disclosure.

FIG. 12A presents an isometric view of a deblinding apparatus 1200, in accordance with one or more embodiments of the disclosure. Deblinding apparatus 1200 includes sixteen compartments $\mathbf{1220}_1$ to $\mathbf{1220}_{16}$. Compartment $\mathbf{1220}_1$, compartment $\mathbf{1220}_2$, and compartment $\mathbf{1220}_3$ have scattering members assembled therein. The scattering members include first scattering members assembled in a first design within the first compartment $\mathbf{1220}_1$. The scattering members also include second scattering members assembled in a second design within the second compartment $\mathbf{1220}_2$. The scattering members further include third scattering members assembled in a third design characterized by a symmetry group within the second compartment $\mathbf{1220}_3$.

Figure 12B:
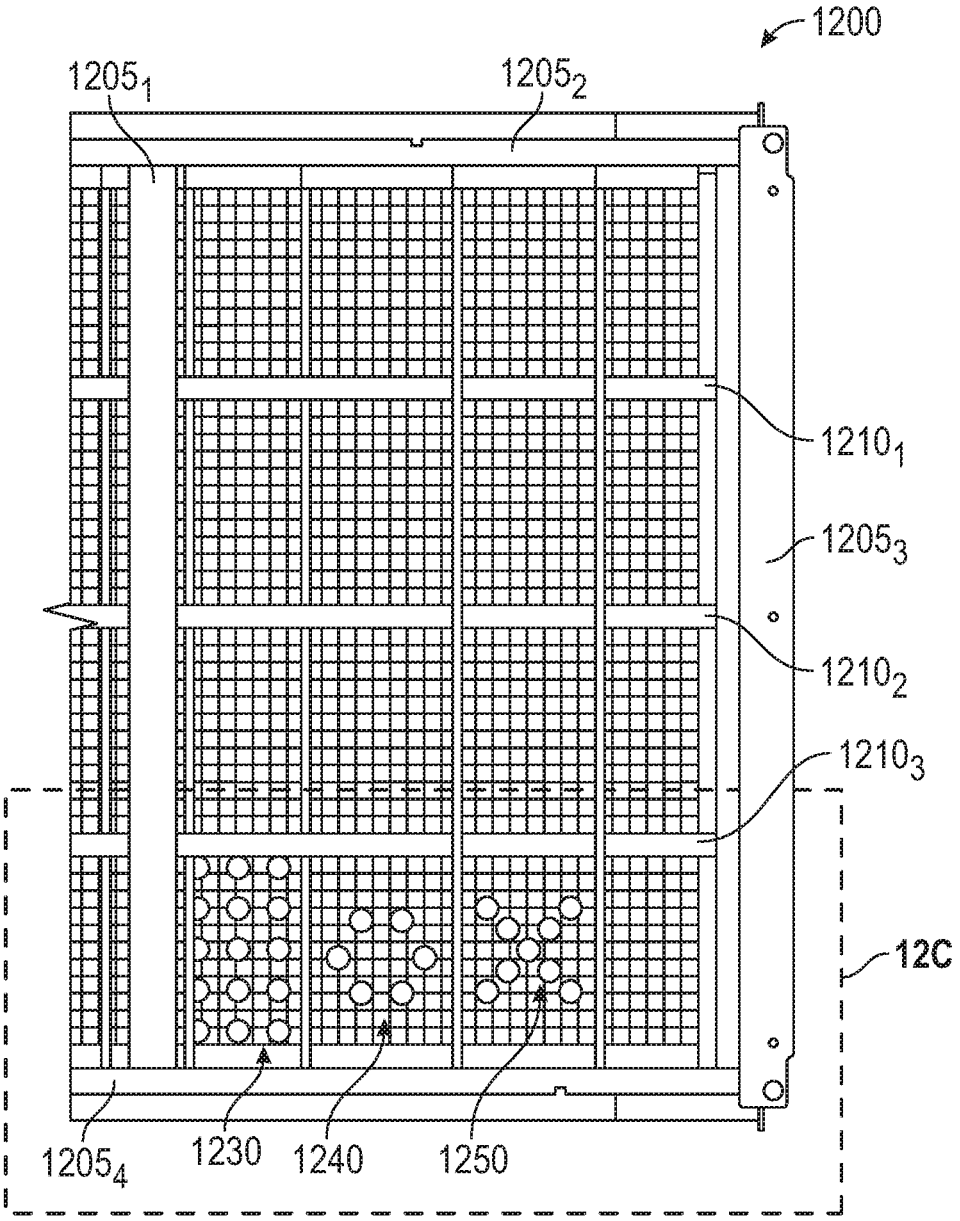
FIG. 12B presents a top view of a portion of the deblinding apparatus shown in FIG. 12A, in accordance with one or more embodiments of the disclosure.

FIG. 12B presents a top view of a portion of deblinding apparatus 1200 shown in FIG. 12A, in accordance with one or more embodiments of the disclosure. As illustrated, scattering members 1230 may include fifteen scattering members having respective substantially circular bases and forming a portion of a square lattice. Scattering members 1240 include six scattering members having respective substantially circular bases arranged at vertices of a hexagon. Scattering members 1250 include nine scattering members having respective substantially circular bases arranged in a cross design.

Figure 12C:
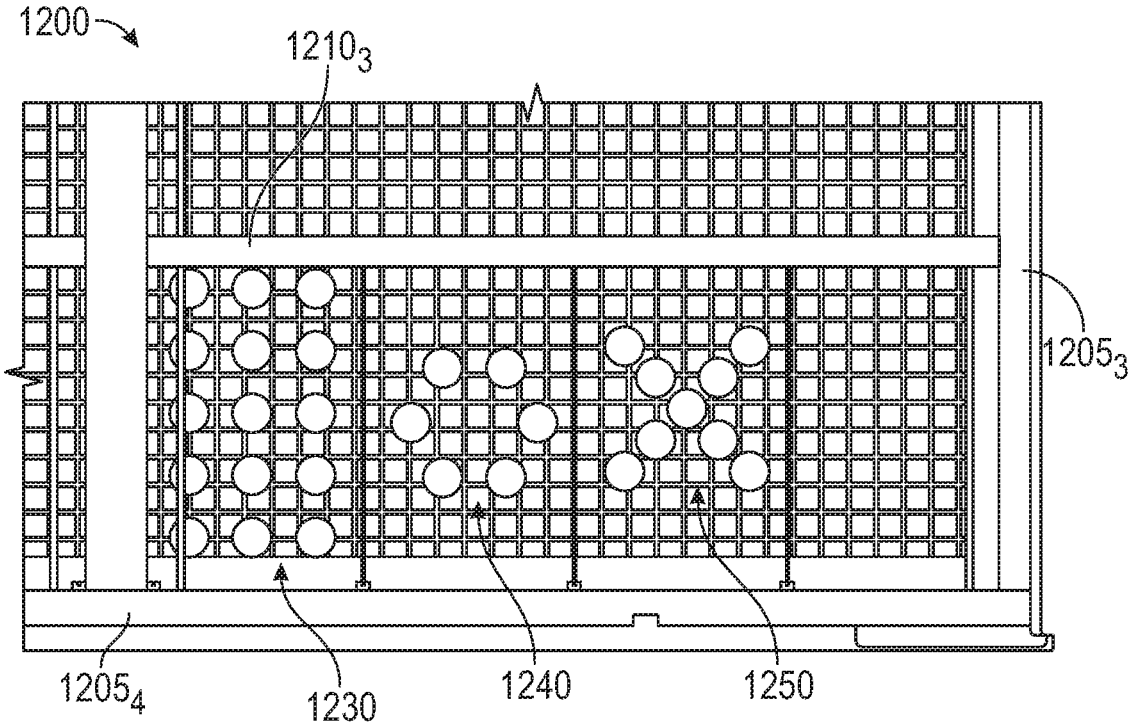
FIG. 12C presents a top view of a portion of the deblinding apparatus shown in FIG. 12A, in accordance with one or more embodiments of the disclosure.

FIG. 12C presents a top view of a portion of deblinding apparatus 1200 shown in FIG. 12A, in accordance with one or more embodiments of the disclosure. A number and arrangement of scattering members within a compartment of deblinding apparatus 1200 may provide coverage of a surface of the compartment. Different amounts of coverage may cause respective rates of collision between an unsecured impact member and a screen assembly (e.g., screen 1010 of FIG. 10) attached to deblinding apparatus 1200 shown in FIG. 12A.

In some embodiments, compartments of a deblinding apparatus may be delimited by curved sidewalls, as described below with reference to FIG. 13. A frame and compartments formed by curved sidewalls may constitute a support frame for a deblinding apparatus, in accordance with embodiments of the disclosure. Compartments formed by curved sidewalls (e.g., tubular shells) may each have a similar size and may be arranged uniformly in an array. In one embodiment, such compartments may be abutted against one another to form the array, with a subset of peripheral compartments abutted against a frame. In another embodiment, a portion of the compartments may be abutted against one another and abutted to bars extending between opposing edges of the frame.

Figure 13:
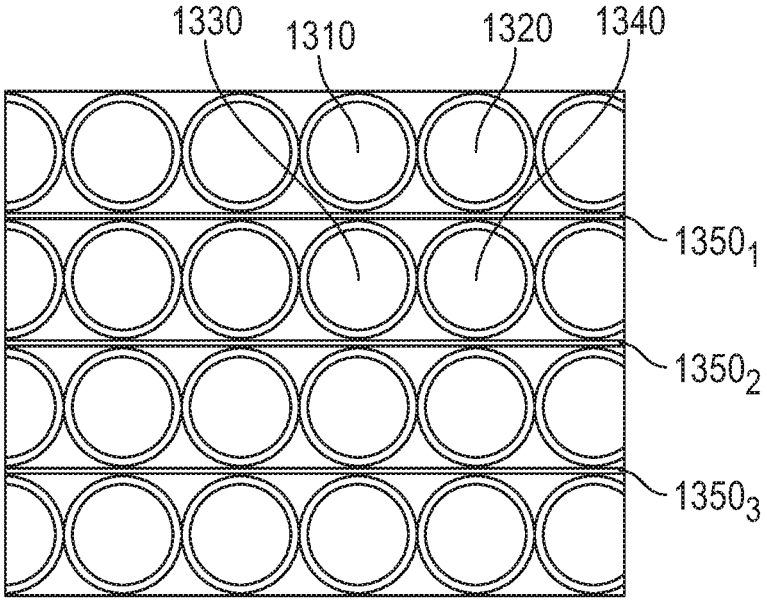
FIG. 13 presents a top view of compartments within a deblinding apparatus, in accordance with one or more embodiments of the disclosure.

FIG. 13 presents a top view of compartments within a deblinding apparatus, according to an embodiment. In this example, substantially circular sleeves form respective sidewalls of respective compartments. For example, a first substantially tubular shell (e.g., sleeve 1330) may be abutted against an adjacent second substantially tubular shell (e.g., sleeve 1340) and also abutted against a first bar $\mathbf{1350}_1$ and a second bar $\mathbf{1350}_2$. As mentioned above, several types of scattering members may be assembled in a deblinding apparatus, in accordance with embodiments of the disclosure. FIGS. 14A to 14D illustrate views of an example scattering member, in accordance with one or more embodiments of the disclosure.

Figure 14A:
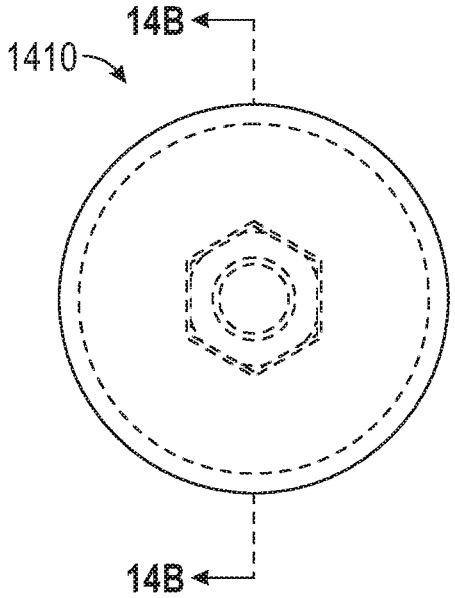
FIG. 14A presents a top view of a scattering member, in accordance with one or more embodiments of the disclosure.

FIG. 14A presents a top view 1410 of a scattering member. The scattering member may have a substantially circular base, in accordance with one or more embodiments of the disclosure. As is illustrated in the cross-sectional view 1420 in FIG. 14B, the scattering member may include a hollow spherical cap 1422 and a fastening mechanism. In one aspect, the fastening mechanism may permit removably affixing the scattering member to a grid structure (e.g., grid structure 130) the deblinding apparatus. The fastening mechanism may include a fastening member 1426 that may be held by the hollow substantially spherical cap 1422, as is shown in FIG. 14B and FIG. 14C.

Figure 14B:
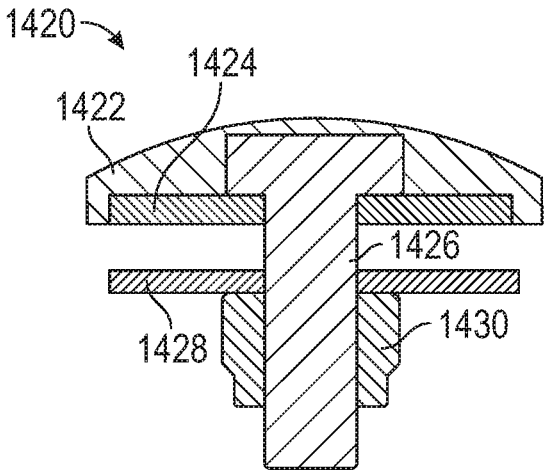
FIG. 14B presents a cross-sectional view of the scattering member shown in FIG. 14A, in accordance with one or more embodiments of the disclosure.
Figure 14C:
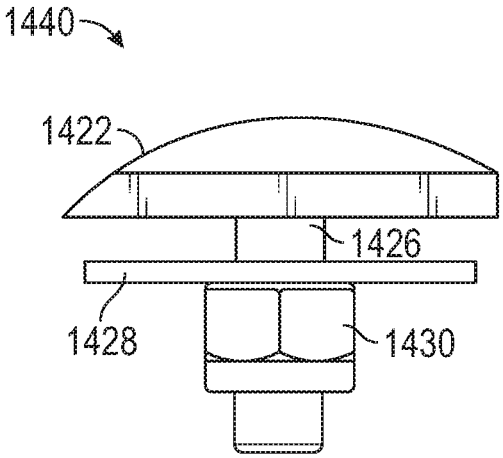
FIG. 14C presents a side view of the scattering member shown in FIG. 14A, in accordance with one or more embodiments of the disclosure.

Fastening member 1426 may be a hexagonal threaded bolt (as is shown in FIG. 14A and FIG. 14B) or may be another type of threaded bolt. The fastening mechanism also may include a first washer member 1424 that may provide support for the fastening member 1426. The first fastening member 1426 may be configured to fit through an opening in the grid structure. Further, the fastening mechanism may include a second washer member 1428 and a second fastening member 1430. The second washer member 1428 and the second fastening member 1430 may be a fastening arrangement of the scattering member. The second fastening member 1430 may be a hexagonal threaded nut, for example, and may be configured to engage the first fastening member 1426. The washer member 1428 may receive a portion of the fastening member 1426.

Figure 14D:
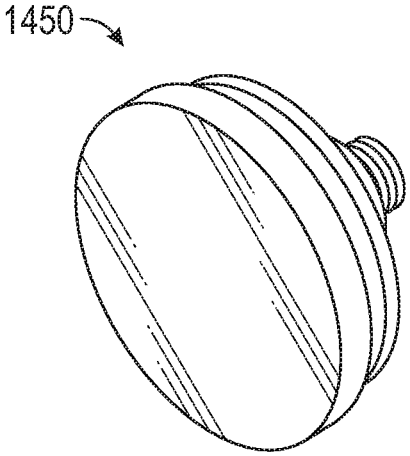
FIG. 14D presents a perspective view of the scattering member shown in FIG. 14A, in accordance with one or more embodiments of the disclosure.

After being removably affixed, the substantially spherical cap 1422 may protrude over a surface of the grid structure of the deblinding apparatus and may cause collisions of an unsecured impact member with a surface of a screen assembly of the deblinding apparatus. Further, the second washer member 1428 may be abutted against a second surface of the grid structure, the second surface opposite the first surface and proximate to an opening that receives the first fastening member 1426. FIG. 14D presents a perspective view of the scattering member that includes the substantially spherical cap 1422 and associated fastening mechanism.

Figure 15A:
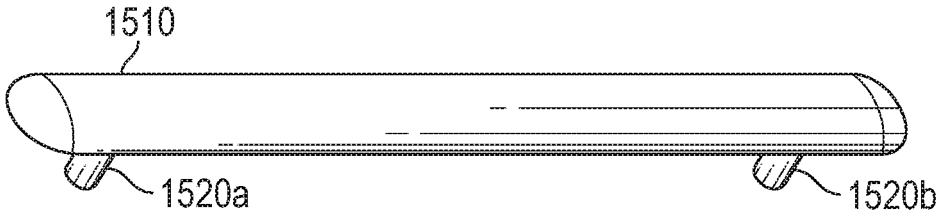
FIG. 15A presents a perspective view of a scattering member, in accordance with one or more embodiments of the disclosure.
Figure 15B:
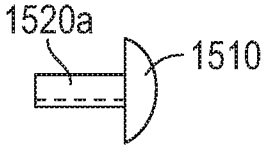
FIG. 15B presents a side view of the scattering member shown in FIG. 15A, in accordance with one or more embodiments of the disclosure.
Figure 15C:
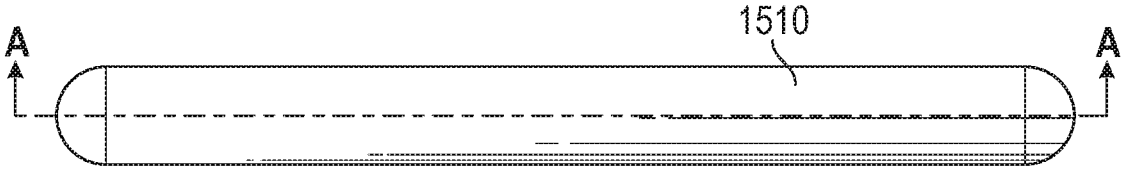
FIG. 15C presents a top view of the scattering member shown in FIG. 15A, in accordance with one or more embodiments of the disclosure.
Figure 15D:
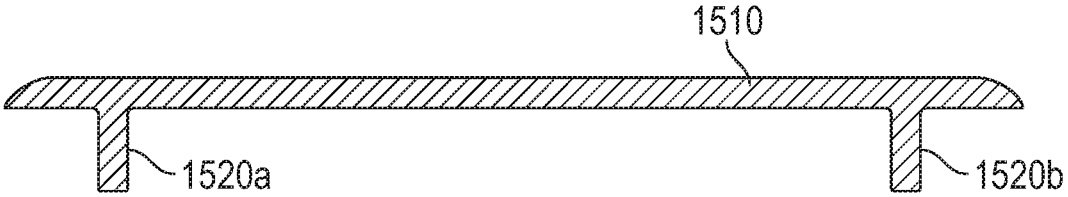
FIG. 15D presents a cross-section view of the scattering member shown in FIG. 15C, in accordance with one or more embodiments of the disclosure.

FIGS. 15A to 15D illustrate various views of another example scattering member, in accordance with one or more embodiments of the disclosure. For example, FIG. 15A illustrates a perspective view of the scattering member. FIG. 15B and FIG. 15C illustrate, respectively, a side view and a top view of the scattering member. FIG. 15D illustrates a cross-sectional view in a cut along the $\overline{AA}$ segment shown in FIG. 15C.

As is illustrated in FIG. 15A, for example, the scattering member includes a strip body 1510 elongated along a longitudinal axis. In some embodiments, the strip body 1510 may include a first threaded protrusion 1520*a* and a second threaded protrusion 1520*b* opposite the first threaded protrusion 1520*a* along the longitudinal axis. In other embodiments, the first threaded protrusion 1520*a* and the second threaded protrusion 1520*b* may be attached to the strip body 1510. The first threaded protrusion 1520*a* may be configured to fit through a first opening in a portion of a grid structure, and the second threaded protrusion 1520*b* may be configured to fit through a second opening in the portion of the grid structure.

The first threaded protrusion 1520*a* may be configured to receive a fastening arrangement that may permit removably affixing the scattering member to a portion of the grid structure. The fastening arrangement may include a washer member and a fastening member. The fastening member may be configured to abut the washer member against the portion of the grid structure, proximate to the first opening. The second threaded protrusion 1520*b* may be configured to receive another fastening arrangement that includes a washer member and a fastening member configured to abut the washer member against another region of the portion of the grid structure, proximate the second opening.

Unsecured impact members (an secured impact members described below) may be solids having various shapes and respective masses in a range from about 10 g to about 100 g and in certain embodiments from about 23 g to about 46 g. In further embodiments, the masses of impact members may be in a range from about 20 g to about 40 g. In some embodiments, impact members may have substantially spherical symmetry. As mentioned above, a size, shape, mass, and morphology (e.g., with or without a through-hole) of unsecured impact members may be designed to optimize a collision rate of unsecured objects with scattering members and with the screen assembly. For example, for a given acceleration that is determined by an imposed vibration of a deblinding apparatus, increasing the mass increases the force, and decreasing the mass decreases the force with which an impact member collides with a screen or screening assembly. Too much force can cause damage to the screen or screening assembly while a force that is too small may be insufficient to cause deblinding. Thus, the mass and other parameters may be tuned to provide effective deblinding while not causing damage.

Figures 16A, 16B, 16C, 16D, 16E, 16F:
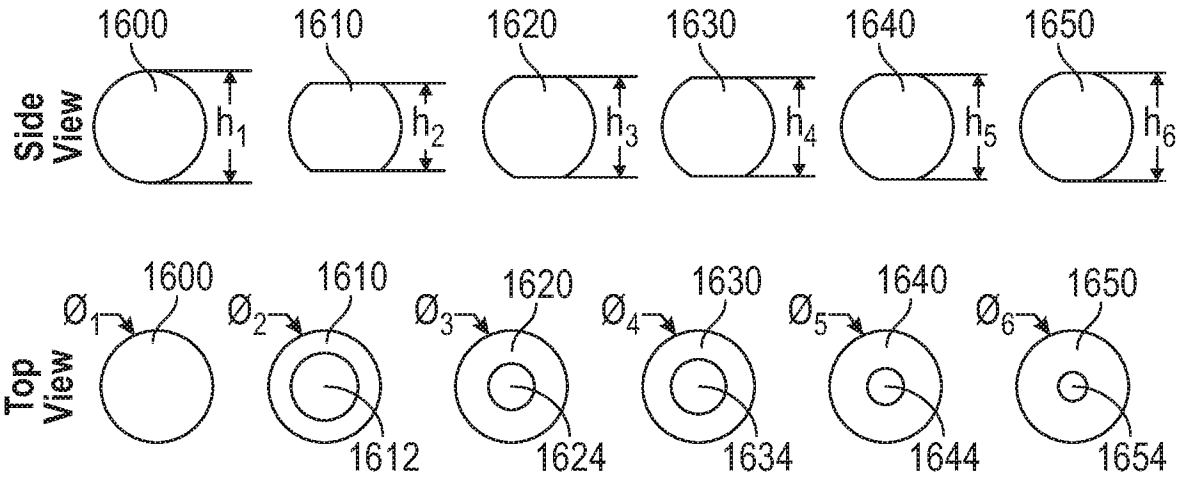
FIG. 16A presents a side view and a top view of an impact member, in accordance with one or more embodiments of the disclosure.
FIG. 16B presents a side view and a top view of an impact member, in accordance with one or more embodiments of the disclosure.
FIG. 16C presents a side view and a top view of an impact member, in accordance with one or more embodiments of the disclosure.
FIG. 16D presents a side view and a top view of an impact member, in accordance with one or more embodiments of the disclosure.
FIG. 16E presents a side view and a top view of an impact member, in accordance with one or more embodiments of the disclosure.
FIG. 16F presents a side view and a top view of an impact member, in accordance with one or more embodiments of the disclosure.

FIG. 16A presents a side view and a top view of an example impact member 1600, in accordance with one or more embodiments of the disclosure.

Impact member 1600 may be a substantially spherical solid having a diameter $\phi_1$ of about 41.30 mm and a mass of about 46 g. The height $h_1$ is essentially the same as in view of the substantially spherical symmetry.

In other embodiments, impact members may have substantially cylindrical symmetry and respective masses in the range from about 23 g to about 46 g. Such impact members may be formed, for example, by removing an amount of mass from a substantially spherical solid. More specifically, a bore (e.g., a substantially cylindrical through hole) may be formed along a principal axis of the substantially spherical solid, resulting in an impact member that is substantially cylindrically symmetric.

FIGS. 16B to 16F present side view and a top views of example impact members, in accordance with one or more embodiments of the disclosure. Each of the illustrated impact members is substantially cylindrically symmetric and has a through hole. FIG. 16B presents a side view and a top view of an impact member 1610 having a through-hole 1612. Impact member 1610 has a mass of about 23 g and a height $h_2$ of about 32.57 mm. Further, impact member 1610 has a substantially circular cross-section having an outer diameter $\phi_2$ of about 41.30 mm and an inner diameter of about 25.40 mm.

FIG. 16C presents a side view and a top view of an impact member 1620 having a through-hole 1624. Impact member 1620 has a mass of about 34 g and a height $h_3$ of about 37.27 mm. Further, impact member 1620 has a substantially circular cross-section having an outer diameter $\phi_3$ of about 41.30 mm and an inner diameter of about 17.80 mm.

FIG. 16D presents a side view and a top view of an impact member 1630 having a through-hole 1634. Impact member 1630 has a mass of about 30 g and a height $h_4$ of about 35.74 mm. Further, impact member 1630 has a substantially circular cross-section having an outer diameter $\phi_4$ of about 41.30 mm and an inner diameter of about 20.70 mm.

FIG. 16E presents a side view and a top view of an impact member 1640 having a through-hole 1644. Impact member 1640 has a mass of about 39 g and a height $h_5$ of about 38.93 mm. Further, impact member 1640 has a substantially circular cross-section having an outer diameter $\phi_5$ of about 41.30 mm and an inner diameter of about 13.79 mm.

FIG. 16F presents a side view and a top view of an impact member 1650 having a through-hole 1654. Impact member 1650 has a mass of about 42 g and a height $h_6$ of about 39.99 mm. Further, impact member 1650 has a substantially circular cross-section having an outer diameter $\phi_6$ of about 41.30 mm and an inner diameter of about 10.32 mm. In embodiments of the present disclosure impact members may have varying outer diameters (I). In this regard, outer diameters (I) may range from about 20 mm to about 45 mm in certain embodiments.

Figure 17:
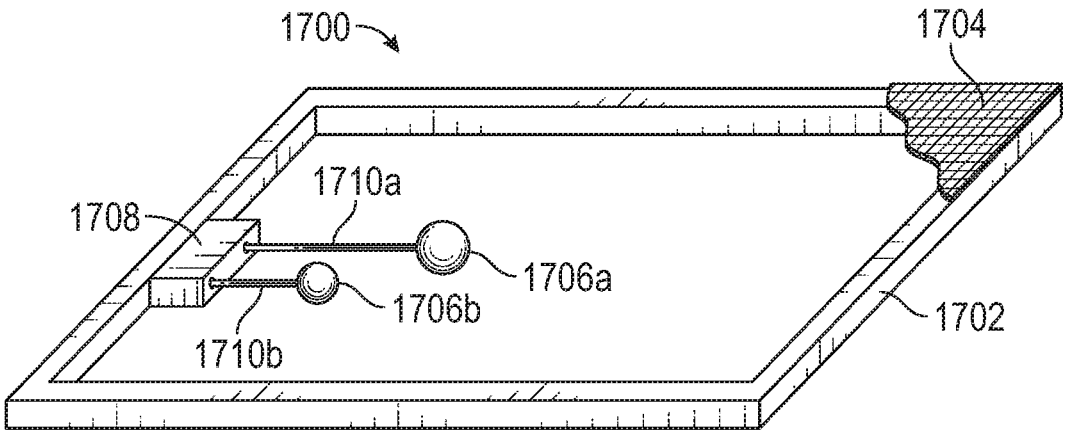
FIG. 17 presents an isometric view of a screening system having a deblinding apparatus, in accordance with one or more embodiments of the disclosure.

FIG. 17 presents an isometric view of a deblinding apparatus 1700 having movable secured impact members, in accordance with one or more embodiments of the disclosure. In this example, deblinding apparatus 1700 may include a frame 1702 that supports a screen assembly 1704. Only a portion of screen assembly 1704 is shown for clarity. Deblinding apparatus 1700 may further include secured impact members 1706*a* and 1706*b*. Impact members 1706*a* and 1706*b* may be connected to a support structure 1708 by members 1710*a* and 1710*b*. Members 1710*a* and 1710*b* may be rubber, plastic, or metal rods or springs that are configured to allow movement of impact members 1706*a* and 1706*b*.

During movement or vibration of deblinding apparatus 1700, impact members are configured to move and to collide with screen assembly 1704 to thereby deblind screen assembly 1704. The force with which impact members 1706*a* and 1706 collide with screen assembly 1704 depends on a length of members 1710*a* and 1710*b*. The mass, as determined by a diameter and mass density, of the members 1710*a* and 1710*b* also determines a frequency and amplitude of oscillation of impact members 1706*a* and 1706*b*. Thus the collision force and frequency of collision may be adjusted by adjusting lengths, diameters, and material properties of members 1710*a* and 1710*b*. This example illustrated an embodiment having two secured secure impact members 1706*a* and 1706*b*. Other embodiments may have only a single secured impact member or may have three or more secured impact members. Further embodiments may also have a plurality of secured impact members that are secured with members (e.g., members 1710*a* and 1710*b*) having a plurality of lengths, masses, etc.

Figure 18:
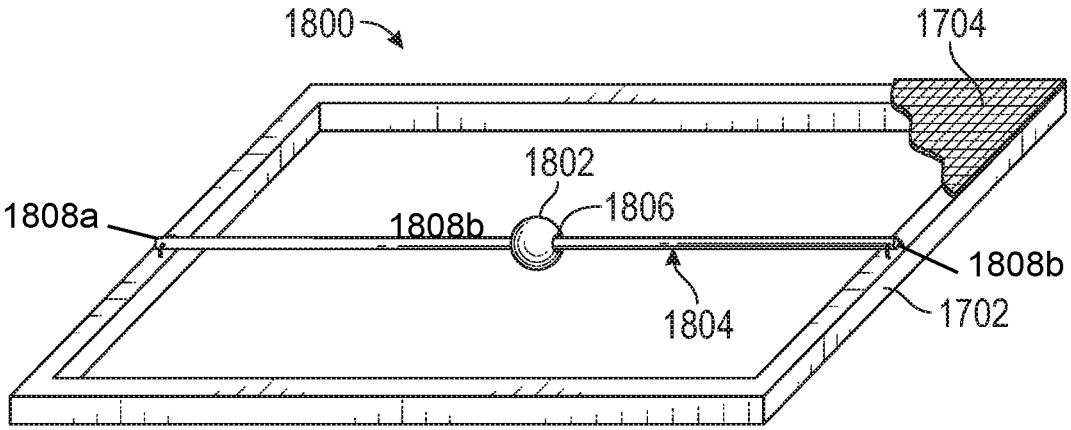
FIG. 18 presents and isometric view of a screening system having a deblinding apparatus, in accordance with one or more embodiments of the disclosure.

FIG. 18 presents an isometric view of a deblinding apparatus 1800, in accordance with one or more embodiments of the disclosure. Deblinding apparatus 1800 is similar to deblinding apparatus 1700 of FIG. 17 in that it includes a frame 1702 that supports a screen assembly 1704. Deblinding apparatus further includes a single, movable secured impact member 1802. Impact member 1802 may be loosely secured by a member 1804. In this example, impact member 1802 is a solid structure having a through-hole 1806.

Member 1804 may be configured to secure impact member 1802 via through-hole 1806. In this regard, impact member 1802 may slide along member 1804 and may vibrate and thereby collide with screen assembly 1704 to thereby deblind screen assembly 1704. In this example, member 1804 may be secured to first 1808*a* and second 1808*b* sides of frame 1702. The stiffness of member 1804 may be varied by adjusting the length, thickness, and material properties of member 1804. In this way, the amplitude of vibration of impact member 1802 and the resulting force with which impact member 1802 collides with screen assembly 1704 may be varied. This example illustrated an embodiment having a single secured impact member 1802.

Other embodiments may have two or more secured impact members with a plurality of masses and other material properties.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The specification and annexed drawings disclose examples of systems, apparatus, devices, and techniques that may provide deblinding of a screen assembly in separator equipment. It is, of course, not possible to describe every conceivable combination of elements and/or methods for purposes of describing the various features of the disclosure, but those of ordinary skill in the art recognize that many further combinations and permutations of the disclosed features are possible. Accordingly, various modifications may be made to the disclosure without departing from the scope or spirit thereof. Further, other embodiments of the disclosure may be apparent from consideration of the specification and annexed drawings, and practice of disclosed embodiments as presented herein. Examples put forward in the specification and annexed drawings should be considered, in all respects, as illustrative and not restrictive. Although specific terms are employed herein, they are used in a generic and descriptive sense only, and not used for purposes of limitation.

What is claimed is:

1. An apparatus, comprising:

a support frame having a plurality of support members;

a grid structure secured to a first side of the support frame;

a screen assembly secured to a second side of the support frame opposite to the first side of the support frame;

a plurality of compartments that are formed by the support frame, grid structure, and screen assembly, with support members of the support frame forming side-walls of the plurality of compartments, portions of the grid structure forming first surfaces of the compartments, and portions of the screen assembly forming second surfaces of the compartments;

at least first and second scattering members disposed within one or more of the compartments, each scattering member being secured to and protruding over a first surface of the grid structure and spaced from a second surface of the screen assembly; and at least one unsecured impact member disposed within each compartment having the first and second scattering members.

2. The apparatus of claim 1, wherein the screen assembly includes a screen having a flexible molded polyurethane body having screening openings.

3. The apparatus of claim 1, wherein the at least one unsecured impact member has a through hole.

4. The apparatus of claim 1, wherein a combined height of a maximum cross-dimension of the at least one unsecured impact member and a height of the first or second scattering member above the first surface is less than a distance between the first surface and the second surface.

5. The apparatus of claim 1, wherein the apparatus is configured so that the at least one unsecured impact member collides with the first and second scattering members and with the screen assembly, wherein collisions between the unsecured impact member and the screen assembly act to deblind the screen assembly.

6. The apparatus of claim 1, wherein at least one of the first and second scattering members has an elongated shape.

7. The apparatus of claim 1, wherein at least one of the first and second scattering members has a circular shape.

8. The apparatus of claim 1, wherein the first scattering member is a first elongated strip that is arranged at an angle relative to the second scattering member, which is a second elongated strip, wherein a relative angle between the first and second strips is between about 0° and about 90°.

9. The apparatus of claim 1, wherein the first and second scattering members include:

one or more threaded portions; and one or more fastening members, wherein the one or more threaded portions are configured to fit through one or more respective openings in the grid structure and to be fastened to the grid structure by engaging one or more fastening members to respective one or more threaded portions.

10. The apparatus of claim 1, wherein at least one of the first and second scattering members includes a hollow substantially spherical cap that holds a fastening member configured to fit through an opening in the portion of the grid.

11. A deblinding apparatus, comprising:

a support frame having a plurality of support members;

a grid structure secured to a first side of the support frame;

a plurality of compartments that are formed by the support frame and grid structure, with support members of the support frame forming side-walls of the plurality of compartments, and portions of the grid structure forming first surfaces of the compartments;

at least first and second scattering members disposed within one or more of the compartments, each scattering member being secured to and protruding over a first surface of the grid structure and spaced below a top edge of the frame; and at least one unsecured impact member disposed within each of the compartments having the scattering members.

12. The deblinding apparatus of claim 11, wherein a combined height of a maximum cross-dimension of the at least one unsecured impact member and a height of the first or second scattering member above the first surface is less than a distance between the first surface and the top edge of the frame.

13. The deblinding apparatus of claim 11, wherein the deblinding apparatus is configured to be secured to a screen assembly, and wherein, in response to movement of the deblinding apparatus, the at least one unsecured impact member is configured to collide with at least one of the first and second scattering members and to further collide with a surface of a screen the screen assembly to thereby deblind the screen assembly.

14. The deblinding apparatus of claim 13, further comprising:

secured impact members that are connected to the support frame by a structure that restricts the movement of the secured impact members, wherein the deblinding apparatus is configured to be secured to a screen assembly and in response to movement of deblinding apparatus, the secured impact members connected by the structure are configured to collide with the screen assembly.

15. The deblinding apparatus of claim 14, wherein the structure comprises one of:

a rubber rod;

a plastic rod; and a metal rod.

16. The deblinding apparatus of claim 11, wherein the first scattering member is a first elongated strip that is arranged at an angle relative to the second scattering member, which is a second elongated strip, wherein a relative angle between the first and second strips is between about 0° and about 90°.

17. The deblinding apparatus of claim 16, wherein the first unsecured impact member has a through hole having a substantially cylindrical cross-section having a second diameter in a range from about 10.3 mm to about 25.4 mm.

18. The deblinding apparatus of claim 11, wherein the support members of the support frame form rectangular side-walls of the plurality of compartments.

19. The deblinding apparatus of claim 11, wherein a first the unsecured impact member has a substantially cylindrical symmetry and a defined mass in a range from about 10 g to about 100 g.

20. The deblinding apparatus of claim 19, wherein the unsecured impact member is formed from a rubber or a plastic.

21. The deblinding apparatus of claim 20, wherein the rubber is selected from a group including silicone rubber, natural rubber, butyl rubber, nitrile rubber, and neoprene rubber.

22. The deblinding apparatus of claim 20, wherein the defined mass is selected from a group including a first mass of about 23 g, a second mass of about 30 g, a third mass of about 34 g, a fourth mass of about 39 g, a fifth mass of about 42 g, and a sixth mass of about 46 g.

23. The deblinding apparatus of claim 11, wherein each of the first and second scattering members is removably affixed to the portion of the grid.

24. An apparatus, comprising:

a support frame having a plurality of support members;

a grid structure secured to a first side of the support frame;

a screen assembly secured to a second side of the support frame opposite to the first side of the support frame;

a plurality of compartments that are formed by the support frame, grid structure, and screen assembly, with support members of the support frame forming side-walls of the plurality of compartments, portions of the grid structure forming first surfaces of the compartments, and portions of the screen assembly forming second surfaces of the compartments;

a scattering member disposed within each of the compartments, the scattering member being secured to and protruding over a first surface of the grid structure and spaced from a second surface of the screen assembly; and an unsecured impact member disposed within each of the compartments, wherein a combined height of a maximum cross-dimension of the unsecured impact member and a height of the scattering member above the first surface is less than a distance between the first surface and the second surface.

* * * * *